US008690671B2

(12) United States Patent
Kaufman

(10) Patent No.: US 8,690,671 B2
(45) Date of Patent: Apr. 8, 2014

(54) THREE-DIMENSIONAL GAMES OF CHANCE HAVING MULTIPLE REEL STOPS

(75) Inventor: Asher A. Kaufman, Las Vegas, NV (US)

(73) Assignee: IGT, Reno, NV (US)

( * ) Notice: Subject to any disclaimer, the term of this patent is extended or adjusted under 35 U.S.C. 154(b) by 1344 days.

(21) Appl. No.: 11/847,280

(22) Filed: Aug. 29, 2007

(65) Prior Publication Data

US 2009/0061983 A1 Mar. 5, 2009

(51) Int. Cl.
*A63F 13/00* (2006.01)

(52) U.S. Cl.
USPC ..... 463/32; 463/16; 463/20

(58) Field of Classification Search
USPC ..... 463/32, 16, 20
See application file for complete search history.

(56) References Cited

U.S. PATENT DOCUMENTS

| | | | | |
|---|---|---|---|---|
| 5,752,881 | A * | 5/1998 | Inoue | 463/20 |
| 6,517,433 | B2 * | 2/2003 | Loose et al. | 463/20 |
| 6,746,329 | B1 * | 6/2004 | Duhamel | 463/20 |
| 2004/0009803 | A1 * | 1/2004 | Bennett et al. | 463/16 |
| 2005/0037843 | A1 | 2/2005 | Wells et al. | |
| 2005/0059487 | A1 * | 3/2005 | Wilder et al. | 463/32 |
| 2005/0192099 | A1 | 9/2005 | Nguyen et al. | |
| 2006/0063594 | A1 | 3/2006 | Benbrahim | |
| 2007/0004513 | A1 | 1/2007 | Wells et al. | |
| 2007/0026935 | A1 | 2/2007 | Wolf et al. | |
| 2007/0026942 | A1 | 2/2007 | Kinsley et al. | |

OTHER PUBLICATIONS

International Search Report and Written Opinion dated Dec. 18, 2008 for corresponding PCT Application No. PCT/US2008/074659.
Zuma Official Site, PopCap Games, Free Download Games, PopCap Games, Inc., 2000-2007, www.popcap.com/games/zuma (4 pages).
Magnetica: The Official Website from Nintendo of America, 2006, http://magnetica.intendods.com/launch/ (1 page).
Luxor, Free Online Game and Download Game from Shockwave, Atom Entertainment, Inc., 1999-2007, http://www.shockwave.com/gamelanding/luxor.jsp (2 pages).
Marble Madness, MobyGames, 1999-2007, http://www.mobygames.com/game/marble-madness (2 pages).
Games: Super Monkey Ball, Nintendo of America Inc., 2007, http://www.nintendo.com/gamemini?gameid=m-Game-0000-617 (1 page).
Examiner's Report for Australian Appl. No. 2008293447, mail date May 23, 2012, 3 pages.
Acceptance Notice for Australian Appl. No. 2008293447, mail date Mar. 18, 2013, 3 pages.

* cited by examiner

*Primary Examiner* — Lawrence Galka
(74) *Attorney, Agent, or Firm* — Foley & Lardner LLP

(57) ABSTRACT

A gaming machine may have at least one display device capable of displaying 3-D images of a game of chance, and at least one processor to execute instructions to display the 3-D images on the display device, the at least one processor having display video data to display the 3-D images for: at least one first object having a first reel stop associated with a first payout value, the at least one first object moving about a central axis, each of the at least one first object having an individual center point, and at least one second object having a second reel stop, the at least one second object moving about the individual center point, the second reel stop associated with a second payout value, wherein the first payout value and the second payout value determine a total payout associated with an outcome of the game of chance.

19 Claims, 17 Drawing Sheets

THREE-DIMENSIONAL GAMES OF CHANCE HAVING MULTIPLE REEL STOPS

FIELD OF THE INVENTION

This invention relates generally to gaming machines. In particular, the invention relates to three-dimensional video data, for output on a gaming machine, having multiple reel stops.

BACKGROUND OF THE INVENTION

As technology in the gaming industry progresses, the traditional mechanically driven reel slot machines are being replaced by electronic machines having a liquid crystal display (LCD) video display or the like. Processor-based gaming machines are becoming the norm. One reason for their increased popularity is the nearly endless variety of games that can be implemented using processor-based technology. The processor-based gaming machines permit the operation of more complex games, advance player tracking, improve security, permit wireless communications, and add a host of digital features that are not be possible on mechanical-driven gaming machines. The increasing cost of designing, manufacturing, and maintaining complex mechanical gaming machines has also motivated casinos and the gaming industry to abandon these older machines. Furthermore, there is a constant desire to develop new games to keep a player's interest.

OVERVIEW

The present invention provides for a game of chance having at least one reel stop for each object on each virtual video reel. In one embodiment, a gaming machine may have at least one display device capable of displaying 3-D images of a game of chance, and at least one processor to execute instructions to display the 3-D images on the display device, the at least one processor having display video data to display the 3-D images for: at least one first object having a first reel stop associated with a first payout value, the at least one first object moving about a central axis, each of the at least one first object having an individual center point, and at least one second object having a second reel stop, the at least one second object moving about the individual center point, the second reel stop associated with a second payout value, wherein the first payout value and the second payout value determine a total payout associated with an outcome of the game of chance.

In another embodiment, a 3-D game reel may have at least one first object having a first reel stop associated with a first payout value, the at least one first object moving about a central axis, each of the at least one first object having an individual center point, and at least one second object having a second reel stop associated with a second payout value, the at least one second object moving about the individual center point, wherein the first payout value and the second payout value determine a total payout associated with an outcome of the game of chance.

In yet another embodiment, a method for displaying a game of chance on a gaming machine may comprise moving at least one first object along a virtual reel path about a central axis, each of the at least one first object having an first individual center point, moving at least one second object about the first individual center point, stopping the at least one first object at a first reel stop along the virtual reel path, the first reel stop associated with a first payout value, stopping the at least one second object at a second reel stop, the second reel stop associated with a second payout value, and determining a total payout associated with an outcome of the game of chance based upon the first payout value and the second payout value.

The present invention provides other hardware configured to perform the methods of the invention, as well as software stored in a machine-readable medium (e.g., a tangible storage medium) to control devices to perform these methods. These and other features will be presented in more detail in the following detailed description of the invention and the associated figures.

BRIEF DESCRIPTION OF THE DRAWINGS

The accompanying drawings, which are incorporated into and constitute a part of this specification, illustrate one or more example embodiments and, together with the description of example embodiments, serve to explain the principles and implementations.

In the drawings.

DESCRIPTION OF EXAMPLE EMBODIMENTS

Embodiments are described herein in the context of three-dimensional (3-D) games of chance having multiple reel stops. The following detailed description is illustrative only and is not intended to be in any way limiting. Other embodiments will readily suggest themselves to such skilled persons having the benefit of this disclosure. Reference will now be made in detail to implementations as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with the present invention, the components, process steps, and/or data structures may be implemented using various types of operating systems, computing platforms, computer programs, and/or general purpose machines.

In addition, those of ordinary skill in the art will recognize that devices of a less general purpose nature, such as hard-wired devices, field programmable gate arrays (FPGAs), application specific integrated circuits (ASICs), or the like, may also be used without departing from the scope and spirit of the inventive concepts disclosed herein.

Figure 1A:
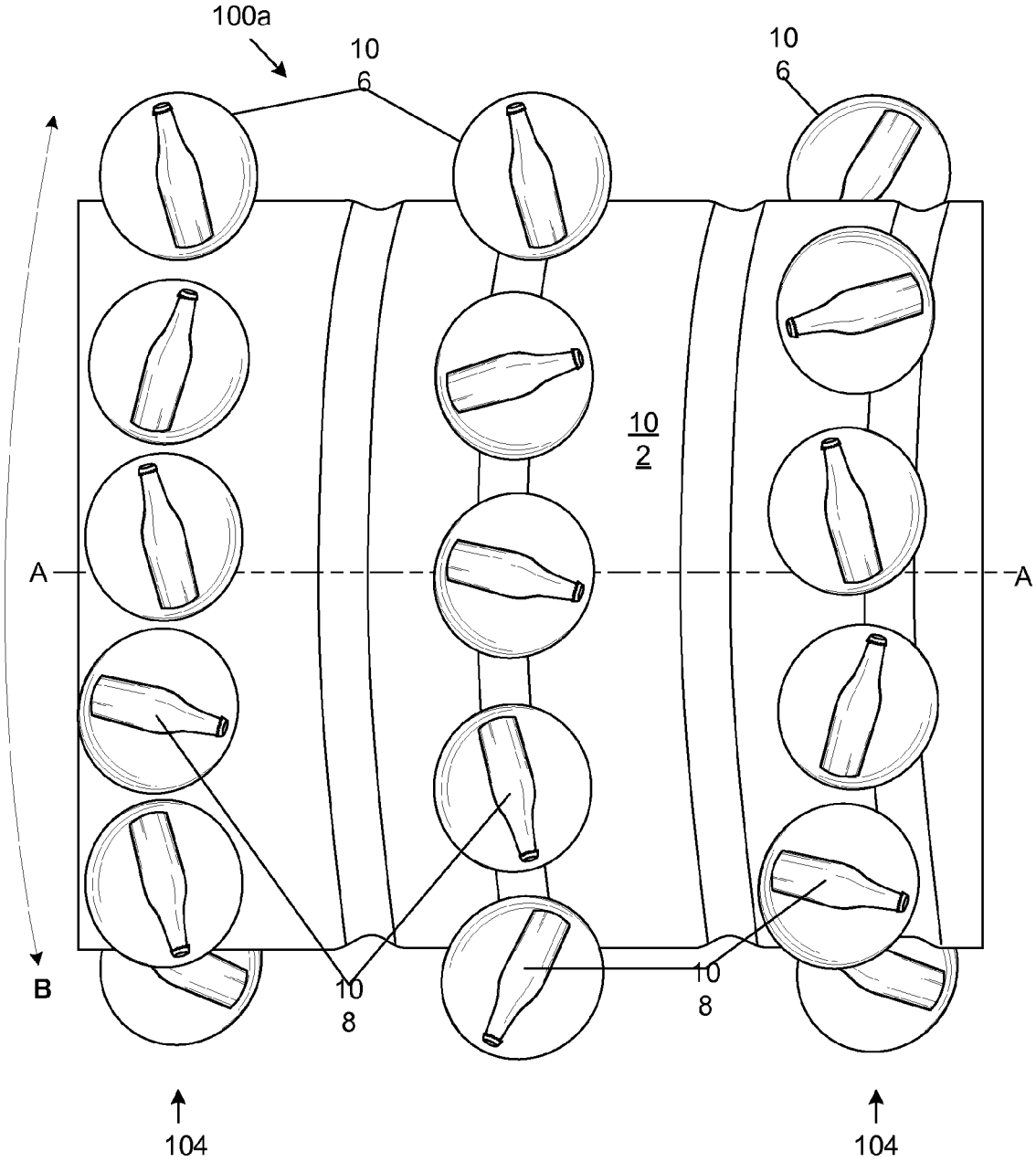
FIGS. 1A-1C illustrate example embodiments of a 3-D game of chance.
Figure 1B:
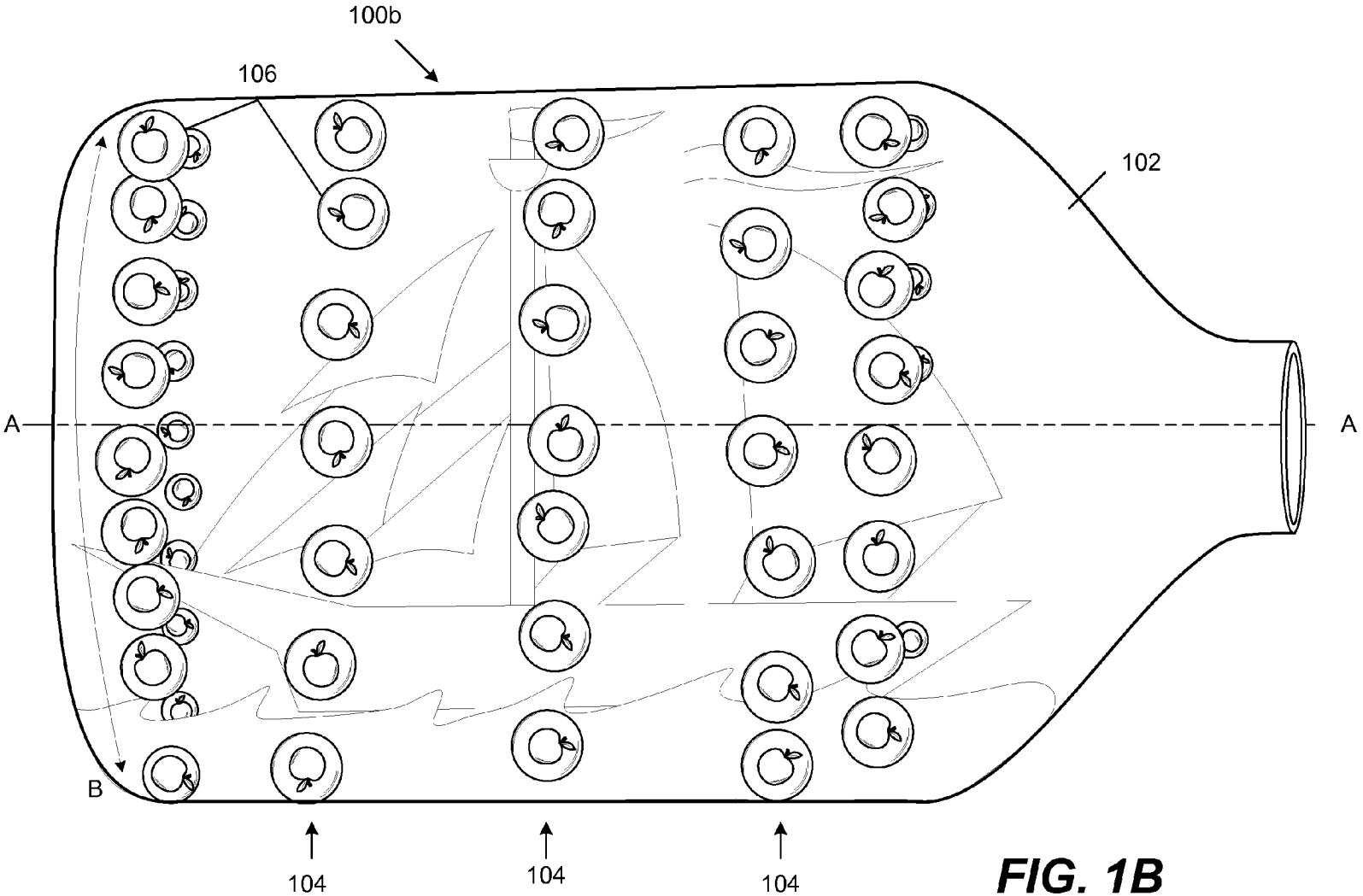
Figure 1C:
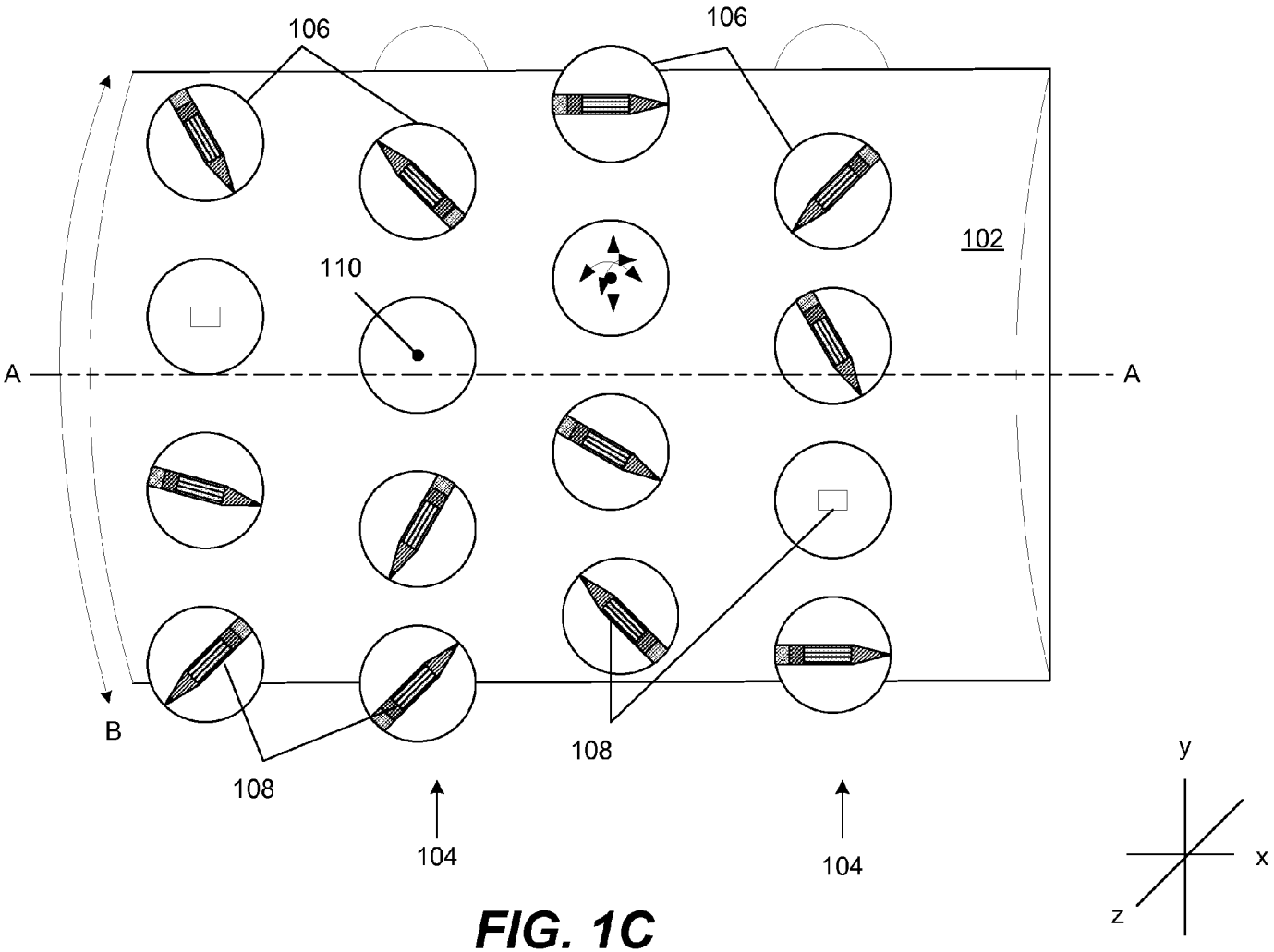

The present invention provides for a game of chance having at least one reel stop for each object on each virtual video reel. FIGS. 1A-1C illustrate example embodiments of a 3-D game of chance. Although illustrated with specific object designs (e.g. a bottle illustrated in FIG. 1A, pencil illustrated in FIG. 1C), the object designs are not intended to be limiting as any designs may be used for the game of chance such as a astronomical objects (e.g. the moon and planets). Furthermore, object designs with animation is contemplated to enhance a player's gaming experience. Referring to FIGS. 1A and 1B, although not necessary, the game of chance 100 may have a background object 102, illustrated as a barrel in FIG. 1A or a ship in a bottle in FIG. 1B. The background object 102 may have a central axis, illustrated by line A, which the 3-D virtual video reels 104 rotate about as illustrated by arrow B. Although illustrated with 3 reels, any number of reels may be used as illustrated in FIGS. 1B and 1C.

Referring also to FIG. 1C, each reel 104 may have a first object 106. The first object 106 is illustrated as a sphere in FIGS. 1A-1C, but may be any 3-D shape, such as a cube, pyramid, polyhedron, and the like as illustrated in FIG. 2. As stated above, the first object 106 may rotate about the central axis of background object 102. The first object 106 may rotate in a clockwise, counter clockwise, or a combination of both directions. Each first object 106 may move or rotate about the central axis so that each object maintains an equal distance between each other. Additionally, the first objects 106 may rotate to give an appearance that the objects 106 are rolling around the background object 102. For example, the first object 106 may have a stripe(s) (e.g. like a beach ball) indicia thereon. The first object 106 may roll in a direction parallel to the stripe(s) to indicate the rolling motion. Thus, the first object 106 may have indicia thereon to indicate motion and/or appear to be in motion to the player.

Each first object 106 may have a second object 108 appearing substantially within the first object 106. The second object 108 may rotate about a center point 110 of the first object 106 along the x, y, or z axis.

Due to the various positions the first object 106 and the second object 108 may move about, each object 106, 108 may have its own reel stop or sphere stop. For example, as illustrated in FIGS. 1A and 1B, each sphere 106 may have a sphere stop at any location along the virtual video reel 104. Additionally, the bottle of FIG. 1B and/or the pencil of FIG. 1C may stop at any orientation on the x, y, or z axis within the sphere 106. Each reel stop may be associated with a payout value. Thus, the reel stop location of the first object 106 may be associated with a certain payout value and the reel stop of the second object 108 may be associated with another payout value.

In one embodiment, the payout values may be a pre-determined variable. For example, a player may obtain 5 credits for the alignment or orientation of all the spheres 106 on a certain payline(s). The player may obtain an additional 3 credits if at least two of the bottles on the payline(s) are oriented upright. In another embodiment, the pre-determined variable may be based upon other factors, such as the player's status in a casino loyalty program, how much credit the player wagered, and the like. Thus, the payout value of the first object 106 and the second object 108 may determine a total payout value for a player. In another embodiment, the payout values may be associated with a promotional program such as bonuses, progressives, customer service promotions, awards, side bets, or any other type of promotional program offered.

The 3-D effects may make the spheres, illustrated in FIGS. 1A-1C, appear to grow in diameter and/or size as the spheres approach the player's view along the virtual reel path and shrink as the spheres recede away from the player's view. The second object 108 may be animated to enhance the 3-D effect of the game of chance 100. For example, liquid may be illustrated spilling out of the bottle of FIG. 1A, depending on the orientation of the bottle. In another example, the water may be illustrated as being splashed when the sphere enters the water in the bottle of FIG. 1B. Moreover, audio effects may also be added to further enhance the player's experience. For example, the sound of liquid splashing may represent the liquid emptying from the bottle of FIG. 1A or the sphere entering or exiting the water in FIG. 1B.

Figure 2A:
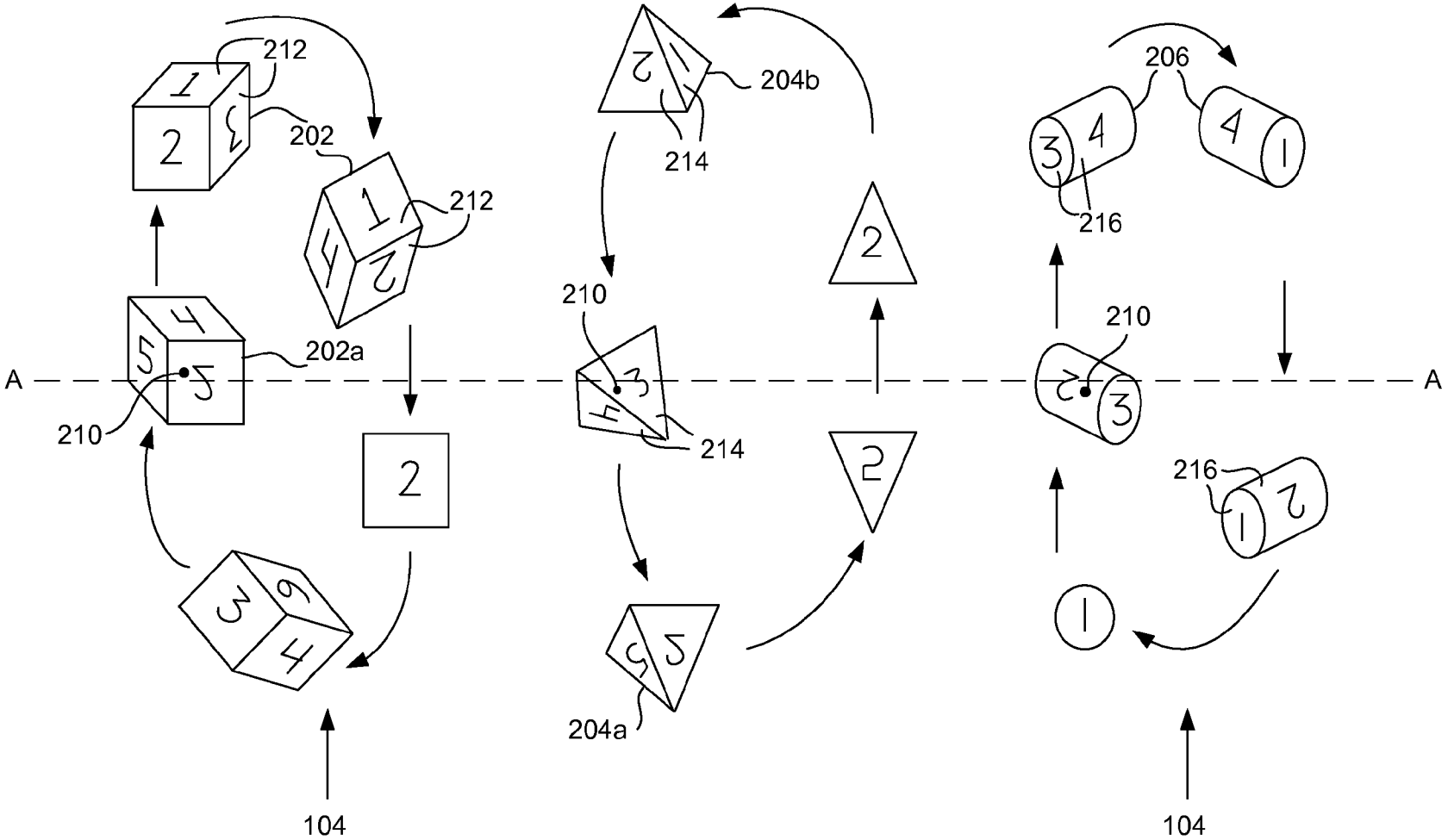
FIGS. 2A-2C illustrate yet another embodiment and method for displaying a 3-D game of chance.
Figure 2B:
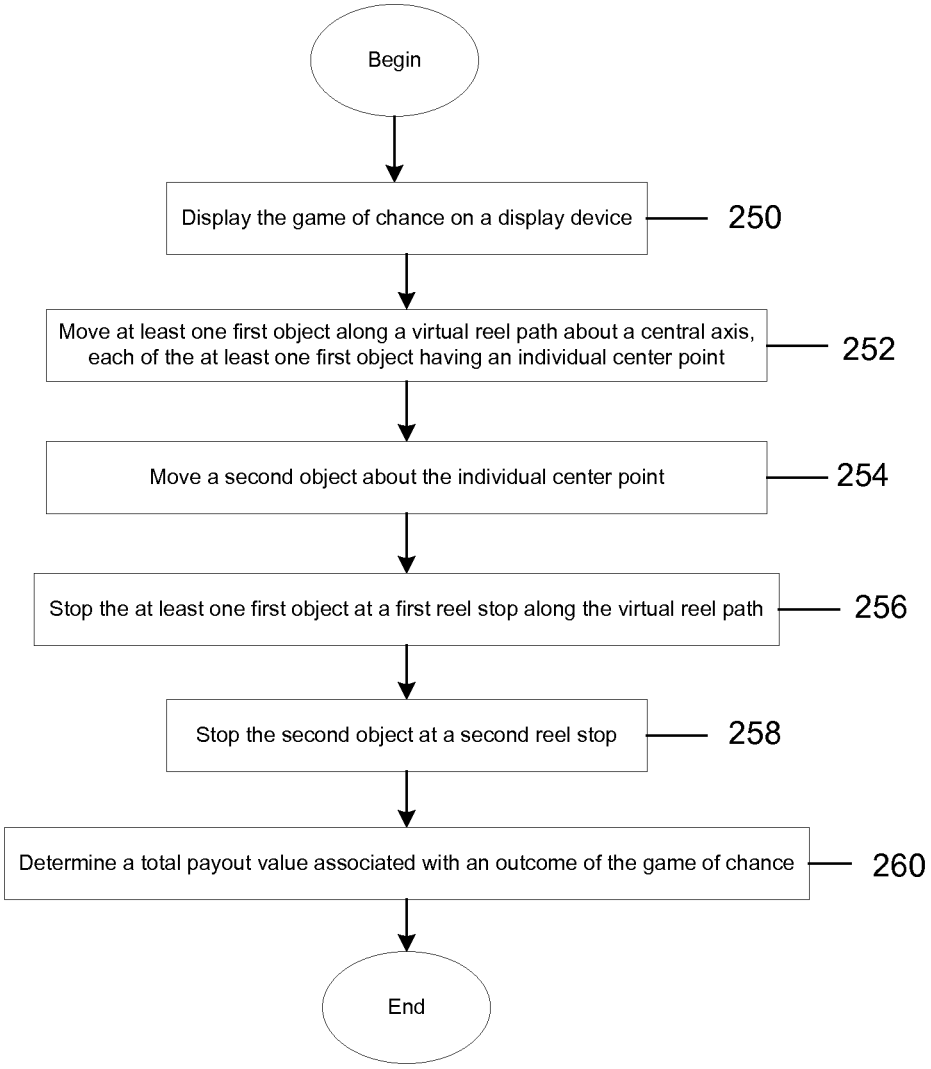
Figure 2C:
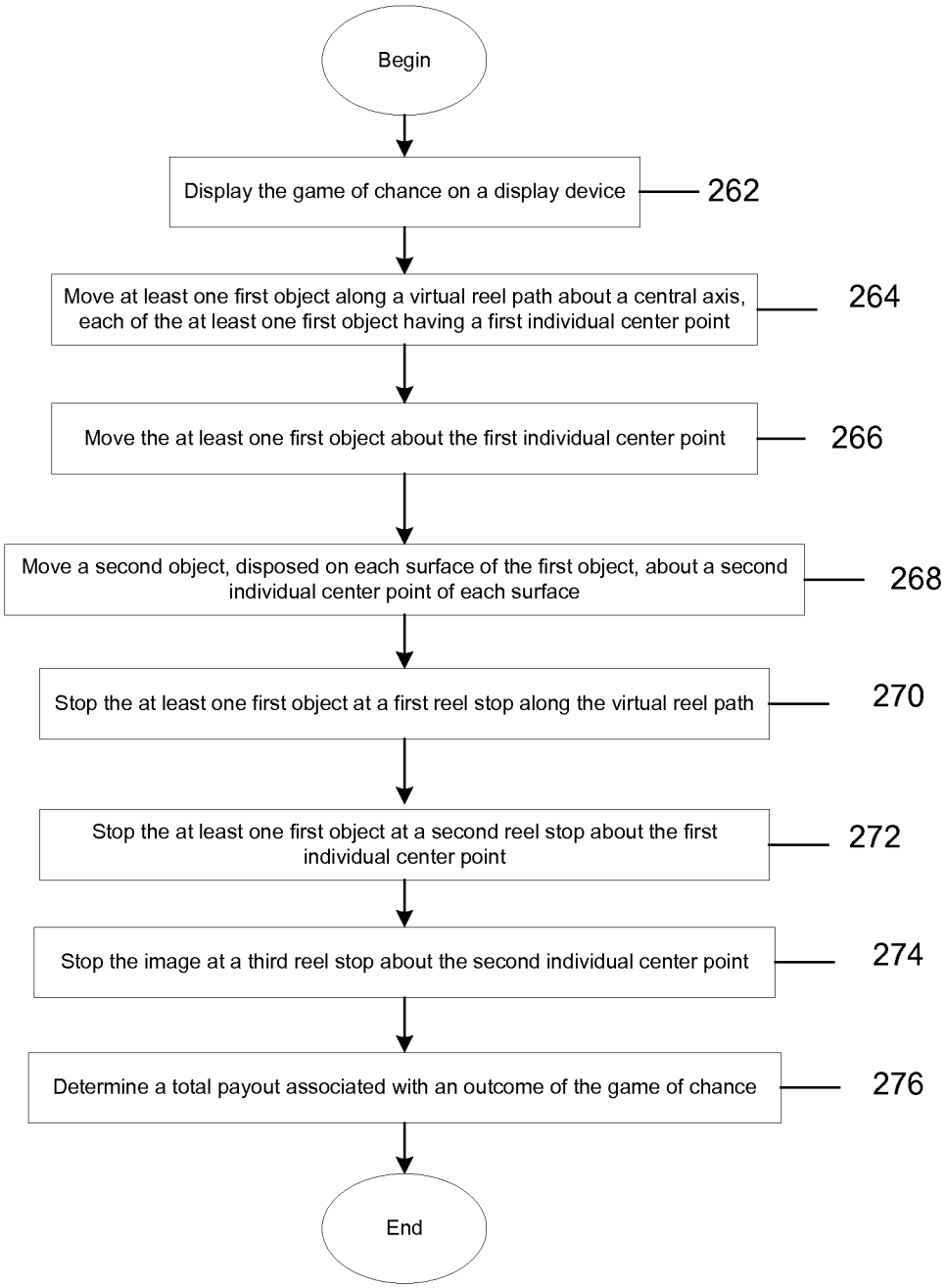

FIGS. 2A-2C illustrate yet another embodiment and method for displaying a 3-D game of chance. Referring to FIG. 2A, the first object may be a cube 202, pyramid 204, cylinder 206, or any other design. As illustrated, the second object may simply be different numbers on each face of the first object 202, 204, 206. For example, the cube 202 may have 6 different numbers on each of its faces 212, the pyramid 204 may have 5 different numbers on each of its faces 214, and the cylinder 206 may have 4 different numbers—one on each opposing face 216 of the cylinder 206. However, the second object may be any other type of image such as the bottles or pencils as illustrated in FIGS. 1A and 1C.

The first object 202, 204, 206 may rotate about a central axis of the virtual reel 104 around line A and may thus have a first reel stop on the virtual reel 104. Each of the first objects 202, 204, 206 may also move about its own individual center point 210 about the x, y, and/or z-axis and thus have a second reel stop which stops the first objects 202, 204, 206 at different orientations. As illustrated in FIG. 2, the first object 204*a* may have a reel stop that results in an inverted pyramid whereas first object 204*b* may have a reel stop that results in an upright pyramid. Thus, first object 202, 204, 206 may have multiple reels stops.

Additionally, since the second objects are positioned on the surfaces of first objects 202, 204, 206, this allows for the use of more than one second object, which in turn allows for additional opportunities to win the game of chance. In one embodiment, the second object may be animated to move about the surface of each face of the first object 202, 204, 206 such that it appears that the objects are hoping from one face to another. In another embodiment, the second object may rotate about the center point of the face. Stopping of the second object from rotating about its individual center point 210 results in a third reel stop. The image and/or number that is substantially viewed by the player will be the image and/or number used to determined a payout value. For example, cube 202*a* has a reel stop that illustrates both the numbers 2 and 5. Since the number 2 is substantially viewed by the player, the number 2 will be used to determine the payout value.

Having multiple reel stops and allowing the first object 202, 204, 206 and the second object to move about the individual center point 210 of the first object 202, 204, 206 provides more opportunities for a player to win the game of chance and for a casino to offer the player various ways to win the game of chance. The first and second reel stops for each of the first objects 202, 204, 206 may represent a first and second payout value, respectively, and the third reel stop for each of the second objects may represent a third payout value wherein the first, second, and third payout value determines the total payout value to the player.

FIG. 2B is a flow diagram of a method for displaying a game of chance. The game of chance may be displayed on a display device at 250. The display device may be any type of display capable of displaying 3-D images such as those described below. At least one first object may be moved along a virtual reel path about a center axis at 252. Each of the first objects may have an individual center point that is at the center of the first object. A second object may be moved about each of the individual center points. In one embodiment, the second object may be located substantially within each of the first objects. In another embodiment, the second object may be located on each face of the first object as further described below with reference to FIG. 2C. The first object and the second object may be any type of inanimate or animated design or object as discussed above.

The first object may be stopped at a first reel stop along the virtual reel path at 256. The second object may be stopped at a second reel stop at 258 about the individual center point. The first reel stop may be associated with a first payout value and the second reel stop may be associated with a second pay out value such that a total payout value to a player may be determined for an outcome of the game of chance at 260 based upon the first payout value and the second payout value.

FIG. 2C is a flow diagram of another example method for displaying a game of chance. The game of chance may be displayed on a display device at 262. At least one first object may be moved along a virtual reel path about a central axis at 264. Each of the first objects may have an individual center point at the center of the first object. In addition to moving along the virtual reel path, the first object may be moved about its own individual center point at 266.

The first object may have many surfaces and each surface may have its own center point at the center of the surface. For example a cube may have 6 surfaces and a pyramid may have 5 surface. Each surface of the first object may have an image or second object disposed substantially thereon. The second objects may be the same or different images. The second object on each surface may be moved about the center point of the surface at 268.

The first object may be stopped at a first reel stop along the virtual reel path at 270. The first object may also be stopped at a second reel stop about its own individual center point at 272. The second object on each surface may be stopped at a third reel stop about the center point of the surface at 274.

The first reel stop may be associated with a first payout value, the second reel stop may be associated with a second payout value, and the third reel stop may be associated with a third payout value. When the first object is stopped at the second reel stop, this may result in two or more images being viewed by the player. Thus, the image that is substantially shown to the player may be the image used to determine the second payout value.

The first, second, and third payout values may be used to determine a total payout value for the outcome of the game of chance at 276. In one embodiment, the payout values may be associated with a promotional program such as bonuses, progressives, customer service promotions, awards, side bets, or any other type of promotional program offered. In another embodiment, the payout values may be determined based upon the final orientation of the first and second objects.

Thus, having the first object move about a virtual reel path and its own center point as well as having the second object move about a center point of each surface of the first object provides for a variety of ways a player may win the game of chance. Having multiple reel stops for the first and second objects allows for the possibility to have a variety of paytables and paylines to keep a player interested in playing the game of chance. In one embodiment, the payout values may be associated with a promotional program such as bonuses, progressives, customer service promotions, awards, side bets, or any other type of promotional program offered.

The virtual video reels 104 of the games of chance 100 illustrated in FIG. 1A-1C may be rotated and/or moved at various orientation speeds. For example, the first object 106 and the second object 108 may be rotated at a first speed for a few seconds then rotated at a second speed, which is slower than the first speed, thereby allowing a user to view the animation of the second object. This enhances the playing experience for the player. By allowing the player to view the animation and/or orientation of the second object, the player may get excited and/or anxious about the outcome of the game of chance. This may ensure that the player will return and play the game of chance.

Although illustrated with 3-D virtual video reels, it will now be known that 2-D virtual video reels may also have multiple reel stops as discussed above. For example, the rotation of the panels on the video displays in a Family Feud™ game of chance may have multiple reel stops.

Figure 3A:
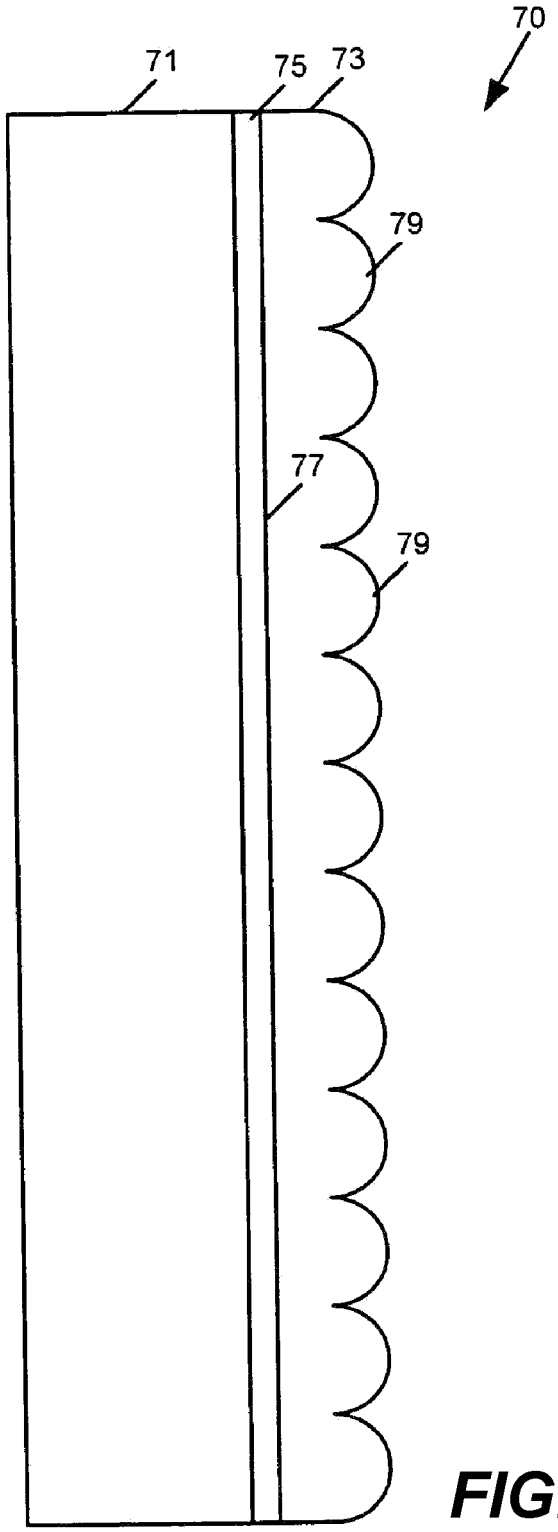
FIGS. 3A-3C illustrate an example display device to display the 3-D game of chance.
Figure 3B:
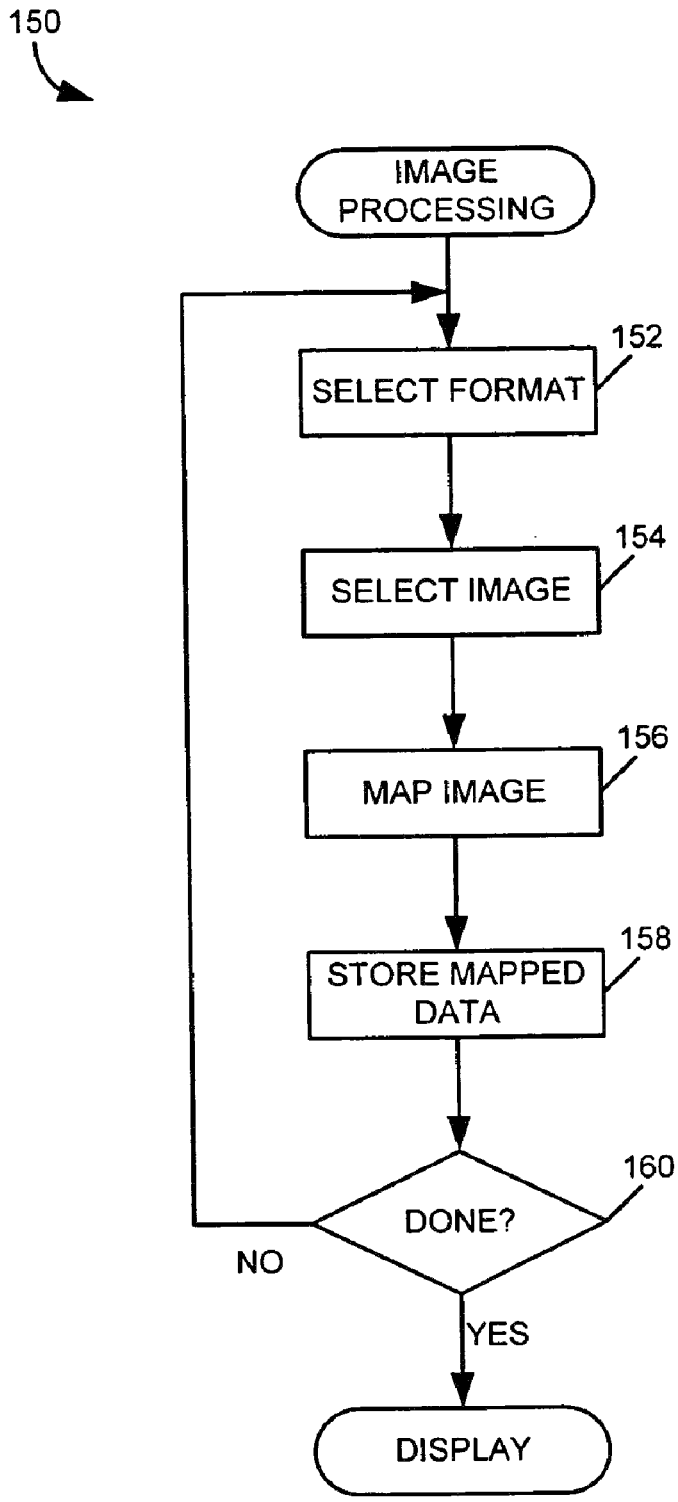
Figure 3C:
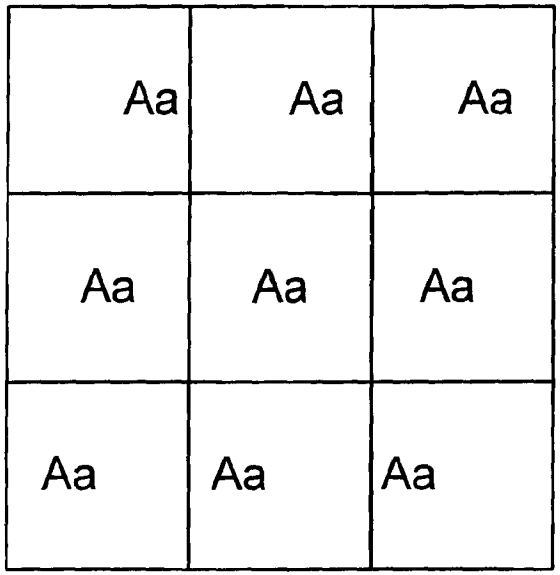

FIG. 3A-3C illustrate an example display device to display the 3-D game of chance. FIG. 3A is a cross-sectional diagram of a 3-D display device. Generally, the display device 70 may include a flat display screen 71 (i.e., a flat-screen display), which may be a plasma display panel (PDP), an LCD, a liquid crystal on silicon (LCOS) display, a light emitting diode (LED) display, a ferroelectric LCD display, a field emissions display (FED), an electroluminescent display (ELD), a front projection display, a rear projection display, and a microelectromechanical device (MEM) display such as a digital micromirror device (DMD) display or a grating light valves (GLV) display, and the like. The display device 70 may further include organic display technologies such as an organic electroluminescent (OEL) display and an organic light emitting diode (OLED) display, as well as a light emitting polymer display. The display device 70 is not limited to flat-panel-display (FPD) technology though most of the above examples are different types of flat screen technology. The pixels of a flat-panel-display allow the image to lie on the surface of the display which may allow the lenticular screen, discussed below, to be more easily aligned with the pixels or sub-pixels (i.e., red, green, blue components). The display device 70 may have a high screen resolution with at least 1000 pixels in each horizontal display line and 1000 in each vertical display line, though the exact number of pixels may be higher or lower depending on the screen ratio. Generally, a display device 70 having at least 1,000,000 pixels total may be considered acceptable. Examples of possible display device 70 resolutions include 1080×1024, 1280×1040, 1600×1200 and 3840×2400.

The display device 70 may also include a lenticular lens or screen 73 disposed on, over or otherwise held in juxtaposition with the viewing surface 75 of the display screen 71. As illustrated in FIG. 3A, the display surface 75 may be provided as a protective glass or transparent polymer sheet disposed over the display screen 71. The lenticular screen 73 may generally have a smooth surface 77 on one side and lenticules 79 disposed on the opposing side. As shown in FIG. 3A, the lenticules 79 may face the observer/player and the smooth surface 77 may face the display surface 75 of the display screen 71. In another example, the smooth surface 77 may include an anti-reflective coating and face the observer/player with the lenticules 79 facing the display surface 75.

The lenticular screen 73 may include lenticules 79 running vertically or at an angle (e.g., slanted). Slanted lenticules 79 may be used to compensate for moire patterns that may result from the optics of the lenticular screen 73 and equalize image resolution in the horizontal and vertical directions. The lenticules 79 may be thin enough so as to not be noticeable or obtrusive to the player/observer, though the size of the lenticules 79 may depend on the particular resolution of the display device 70, the size of the pixels, the number of pixels or sub-pixels aligned with each lenticule 79, or any other variables. If the lenticules 79 face the display screen 71, the lenticules 79 may be less noticeable and obtrusive to the player/observer. Each lenticule 79 may have a focal length that is not less than the thickness of the protective glass 75 such that the focal point is on the same plane as the pixels. If the lenticular screen 73 faces outward with the lenticules 79 facing away from the display screen 71, a larger focal length may be needed.

Each lenticule 79 may be aligned with a particular set or column of pixels or sub-pixels. The lenticular screen 73 may be aligned with the pixels or sub-pixels of the display device 70 using moire interferometry to display an image having multiple perspectives and allow the player/observer to view the different perspectives at different angles. The lenticular screen 73 may be made from a material matching the characteristics of the display screen 71 material, which may be glass or transparent polymer. The matching materials may help to maintain alignment of the pixels with the lenticules 79 due to temperature variations or other effects that may affect the lenticules 79 and the display screen 71. The display device 70 may be an autostereoscopic display sold by Stereographics, Corp. of California under the trademark SynthaGram.

FIG. 3B is a flowchart depicting how image data representing multiple perspectives of an object, and hence multiple images, may be manipulated to be simultaneously displayed on the display device 70 and allow the player/observer to view the different perspectives (i.e., multiple images) of the object from different angles thereby giving the appearance of three-dimensions. Beginning at block 152, previously captured image data may be retrieved and an output format may be selected.

The image data may be captured using multiple cameras arranged in a line along a plane thereby providing an image source from multiple perspectives. The arrangement of the cameras may be dependent on the desired perspective. For example, upper-lower perspectives may require a camera(s) for the upper perspective and a camera(s) for the lower perspective. Each camera may record an image of an object from its perspective and the raw image data may from each camera may be stored. The image may be a static image or an animated image. Alternatively, the object may be created using three-dimensional rendering software and multiple virtual cameras may record an image of the object from different perspectives. While the image data may include two or more perspective views, nine perspective views may be preferable to maintain the aspect ratio of the image and provide sufficient perception of the object in three-dimensions from various angles. Fewer than nine perspective views may lessen the overall angle of view.

If nine perspective views are used, a nine tile format may be selected at block 152 which arranges the various perspective views in a three-by-three pattern as shown in FIG. 3C. The nine images may initially be arranged starting with the leftmost perspective in the top left corner and ending with the rightmost perspective in the bottom right corner, though this may not be how the various perspective views are ultimately displayed on the display device 70. The overall resolution of a single perspective view may thereby be reduced to one-ninth of the overall image resolution. This may also be approximately one-ninth the resolution of the display device 70. If two images are used, a two image horizontal format or a two image vertical format may be selected thereby reducing the overall resolution of a particular perspective view by approximately one-half. The selected format may depend on the number of perspective views recorded, which may be displayed in various arrays (e.g., three-by-three, horizontal side-by-side, vertical side-by-side, etc.). The resolution of a particular perspective view may be approximately the total resolution of the image (or of the display device 70) divided by the number of perspective views being displayed.

Returning to FIG. 3B, after a format has been selected at block 152, image data for a particular perspective view may be selected for processing at block 154. If the image data is an animated video image, each image may be selected and processed on a frame-by-frame basis. At block 156, the routine 150 may map the pixels of the perspective views to the pixels or sub-pixels of the display device 70 so as to juxtapose the pixels or sub-pixels of the perspective views with the lenticules 79 of the lenticular screen 73 for optimum viewing of the various perspectives. The various perspective images may thereby be sampled and interlaced together into a single, multiple-view image. This process may also be known as a form of interdigitation. Software for processing the image is also available from Stereographics, Corp. of California under the name Interzig™. Interdigitation or interlacing may involve sampling the pixels from the image data of each perspective view from the chosen format and determining the best location for each pixel in the final image to produce a single, multiple-view image that is a combination of samplings from each of the perspective images. In other words, the final image is an interdigitated or interlaced image of the various perspectives. When viewed with a lenticular screen 73, the interdigitated image may have the appearance of depth (i.e., appear three-dimensional) where one angle of view has one perspective view and another angle of view had a different perspective view.

The mapping performed at block 156 may be performed on a pixel-by-pixel or subpixel-by-subpixel basis, whereby the routine 150 determines the best fitting pixel image from the nine-by-nine format to display at a particular pixel or sub-pixel of the display device 70. At a given pixel or sub-pixel of the display device 70, the routine 150 may determine that a pixel from the leftmost perspective image may best be displayed at that pixel or sub-pixel. This determination may be based on where the pixel or sub-pixel is positioned in relation to a lenticule 79, and may thereby be calculated for every row or group of pixels or sub-pixels within a particular lenticule 79. Calculations may be performed by any known methods such as those described in co-pending application Ser. No. 10/661,983, entitled "Three-Dimensional Autostereoscopic Image Display For A Gaming Apparatus", filed Sep. 12, 2003, which is incorporated by reference herein in its entirety for all purposes.

When a particular perspective image has been chosen as the best perspective for a particular pixel or sub-pixel, block 156 may further include determining which pixel of the chosen perspective image should be displayed at the pixel or sub-pixel of the display device 70. This may be determined simply by mapping the desired interdigitated sub-pixel or pixel being calculated to the chosen perspective image(s). For example, if the best perspective image is image 5, then the pixel image taken from image 5 may be determined by mapping the location of the pixel or sub-pixel of the final single image (which includes all perspectives) to the coordinates of image 5. Generally, the best fitting pixel mapped from each master image should be used, though a weighted average of the values of several pixels that map to a desired range may also be appropriate.

In some cases, the perspective images may be the same size and/or resolution of the final image of the various perspectives, though the perspective images may also be smaller to simplify the process described above. In either case, pixels may be mapped proportionally from the appropriate perspective image(s) to the final, interdigitated image. For example, the final interdigitated image being calculated may have a grid of 4800 sub-pixels horizontally (which would be the case if the horizontal display resolution was 1600 RGB pixels, and each of those 1600 pixels consisted of three distinct single-color sub-pixels), and 1024 sub-pixels vertically, and the perspective images may each have a smaller resolution of 520 pixels horizontally by 340 vertically. To calculate the value of interdigitated sub-pixel (X,Y) of the final interdigitated image, the best fitting master image pixel may be (X×520/4800, Y×340/1024), where the lower-left pixel in all cases is (0,0). Thus, while the perspective image may have a resolution only a fraction of the display device 70, the routine 150 may determine what is the best fitting pixel from the perspective view.

The above techniques apply regardless of whether the lenticules 79 are parallel to the pixel columns of the display screen 71 or slanted relative to the pixel columns. The only difference between lenticules 79 that are not slanted and lenticules 79 that are slanted is that a slanted lenticule 79 implementation may consider the amount of slant (i.e., the angle) in order to properly calculate the horizontal position L of a pixel relative to the lenticule 79 that is placed above it. If the interdigitated sub-pixel being calculated is red-only, green-only, or blue-only, then only the appropriate color element from the master image pixel(s) may be used.

Once the mapping or interdigitation process is complete, the interdigitated image data may be stored at block 158, with each pixel of the interdigitated image having been assigned a pixel or sub-pixel on the display device 70. The interdigitated image data is made up of the image data from the various perspective views whose pixels are mapped to be precisely positioned with the lenticules 79 of the lenticular screen 73. A digital video interface may ensure that each pixel image of the interdigitated image is displayed at the proper pixel or sub-pixel of the display device 70. At block 160, the routine 150 determines whether all images have been processed. If not, the routine 150 may return to block 152 to repeat the process for another image. If complete, the routine 150 may end the process and the interdigitated image data may be displayed on the display device 70.

Any image displayed on the display device 70 may be displayed as a three-dimensional display, which may sometimes be referred to as an autostereoscopic display. Generally, an autostereoscopic display may involve a technique that allows the player/observer to see depth in the image by combining the perspective images and simultaneously looking at two perspectives of an image without requiring additional viewing glasses or the like. This effect may be accomplished by displaying the interdigitated data with the lenticular screen 73. As discussed above, various perspective views of an object, scene or other image may be interdigitated and stored as interdigitated data. The interdigitated data may be displayed as a combination of multiple perspective views with each view having the appearance of three-dimensions.

Figure 4:
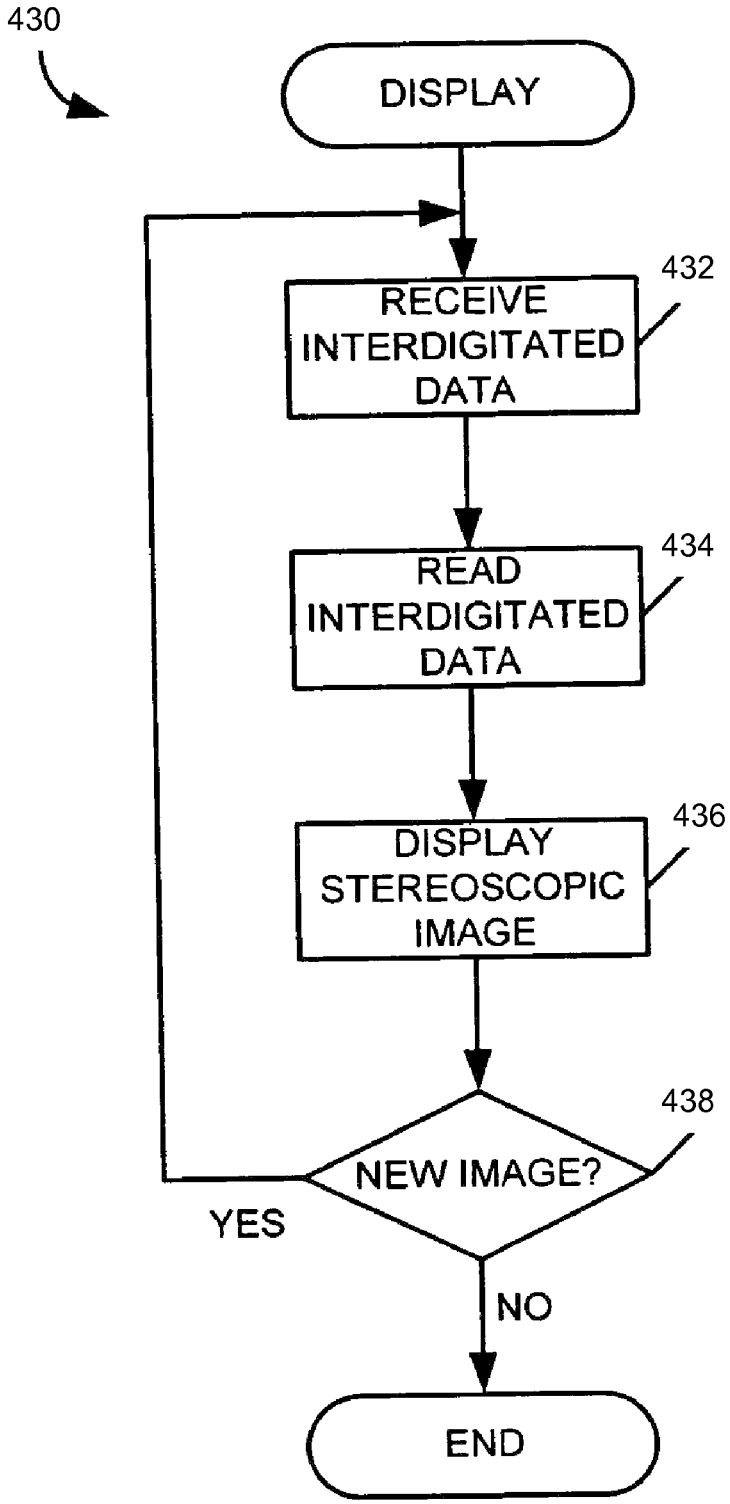
FIG. 4 is a flowchart of an embodiment of a display routine that may be performed during operation of one or more of the gaming units.
Figure 7:
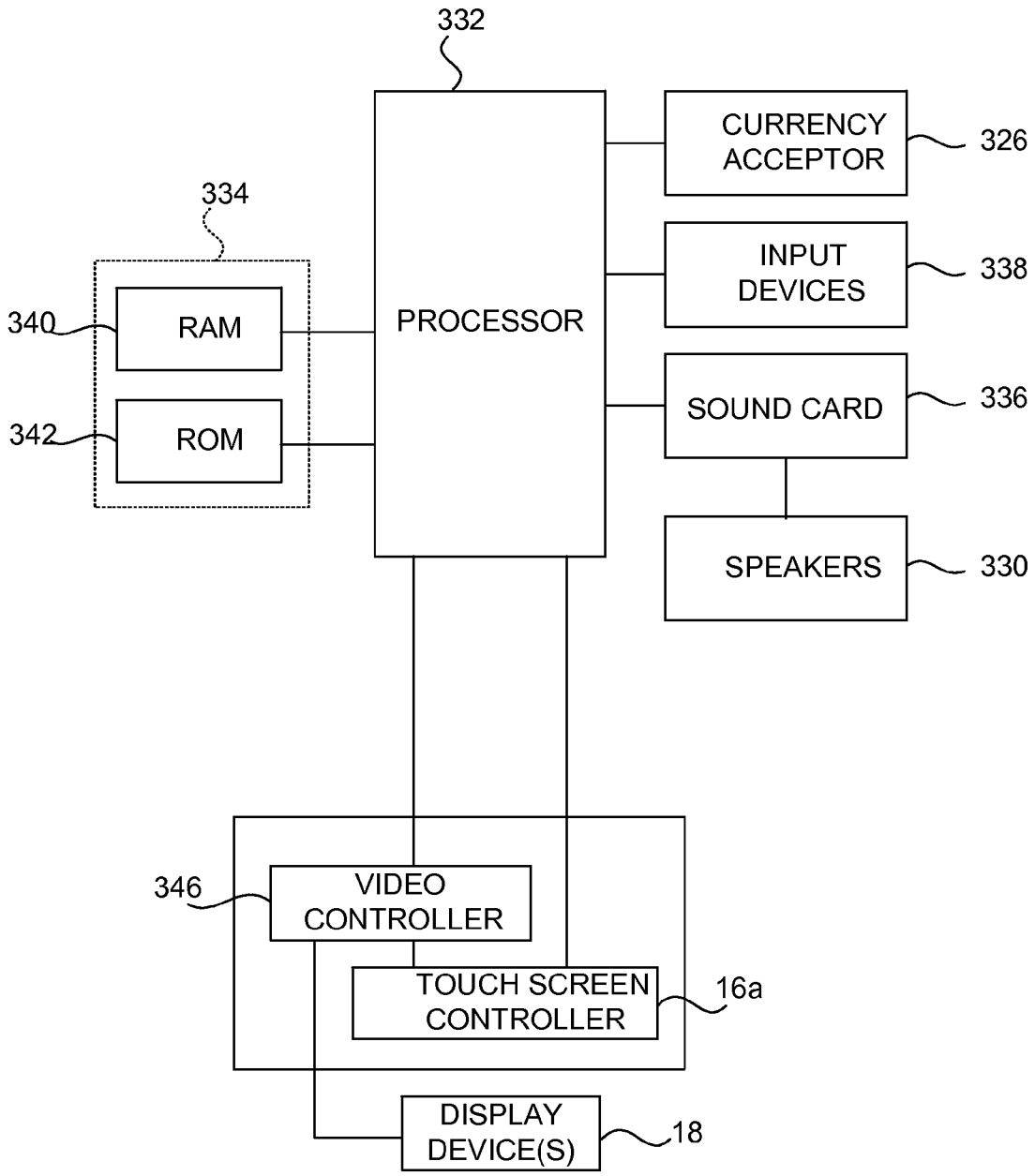
FIG. 7 illustrates a control configuration for use in a gaming machine.

FIG. 4 is a flowchart of a display routine 430 of the 3-D video data that may be stored in the memory 334 of the master gaming controller 332 (FIG. 7). The display routine 430 may begin operation at block 432 during which interdigitated data may be received by the master gaming controller 332 (FIG. 7) and temporarily stored in a memory 334 such as the random-access memory 334 (RAM) 340 (FIG. 7). The interdigitated data may represent a single or multiple images each having multiple perspectives which may be static or animated images. For example, the master gaming controller 332 may receive and store an entire video file of interdigitated data or receive the video file on a frame-by-frame basis.

When the interdigitated data has been received, the master gaming controller 332 may read the interdigitated data at block 434 in order to read and display the three-dimensional, autostereoscopic image. In reading the data, the master gaming controller 332 may read pixel data and mapping information which may be encoded as part of the interdigitated data. The pixel data may allow the master gaming controller 332 to determine the color, intensity, placement, etc. of each pixel or sub-pixel image. The mapping information may allow the master gaming controller 332 to determine where a particular pixel image is to be displayed on the display device 70 such that the player/observer will be able to clearly view multiple perspectives of the image. When the master gaming controller 332 has read the interdigitated data of the image, the master gaming controller 332 may cause the image data to be displayed on the display device 70. Using the mapping data, the master gaming controller 332 may cause each pixel image, or sub-pixel image, to be displayed on a particular pixel or sub-pixel of the display screen 71. The display of the image at block 436 may be performed using a digital video interface (DVI). When displayed according to the mapping data and viewed in conjunction with the lenticular screen 73, the image may have the appearance of three-dimensions with multiple perspectives that change with the viewing angle. When an image has been displayed, the display routine 430 may determine if a new image is to be received and displayed at block 438.

Figure 5A:
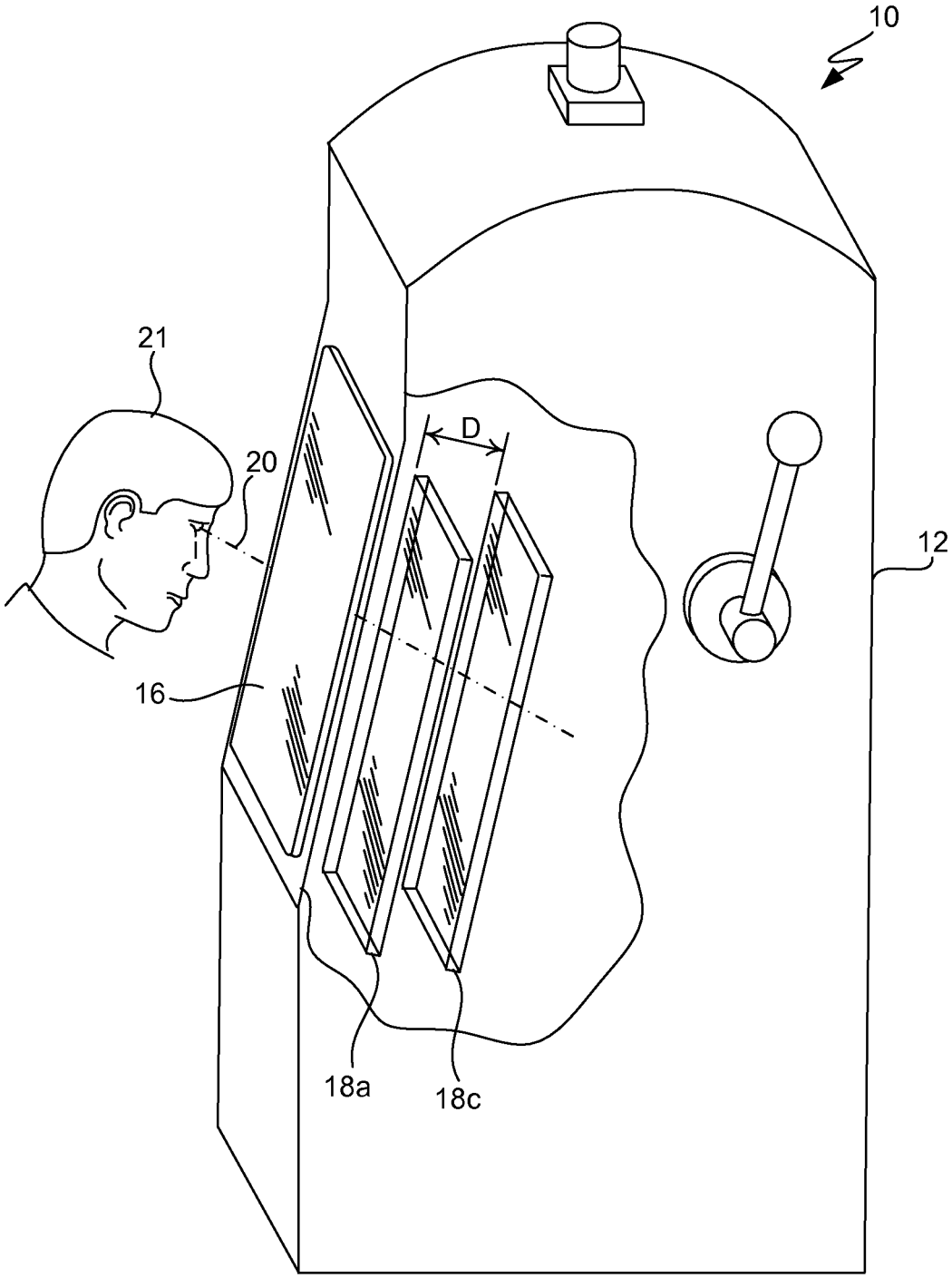
FIGS. 5A-5B illustrate another example display device to display the 3-D game of chance.
Figure 5B:
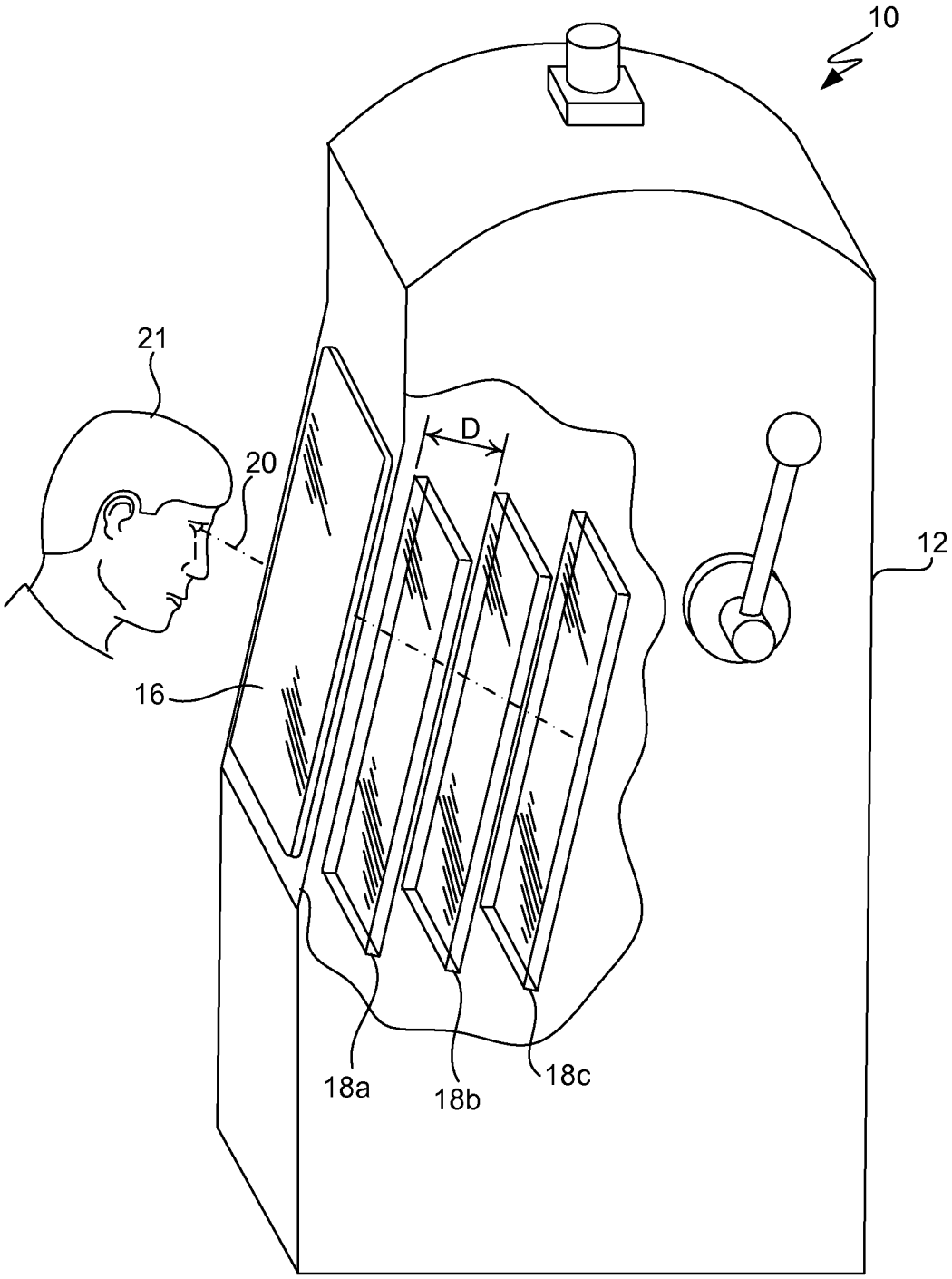

FIGS. 5A-5B illustrate another example display device to display the 3-D game of chance. Referring to FIGS. 5A and 5B, a predetermined spatial distance "D" separates display screens for the layered display devices 18*a* and 18*c*. The predetermined distance, D, represents the distance from the display surface of display device 18*a* to display surface of display device 18*b* (FIG. 5B) or display device 18*c* (FIG. 5A). This distance may be adapted as desired by a gaming machine manufacturer. In one embodiment, the display screens are positioned adjacent to each other such that only a thickness of the display screens separates the display surfaces. In this case, the distance D depends on the thickness of the exterior display screen. In a specific embodiment, distance "D" is selected to minimize spatial perception of interference patterns between the screens.

This distance improves perception of a three-dimensional device. First, spatially separating the devices 18*a* and 18*c* allows a person to perceive actual depth between video output on display device 18*a* and video output on rear display device 18*c*.

In one embodiment, the video data are output on a gaming machine having a single display device that outputs video information for a game. As the term is used herein, a display device refers to any device configured to output a visual image in response to a control signal. In one embodiment, the display device includes a screen of a finite thickness, also referred to herein as a display screen. For example, LCD display devices often include a flat panel that includes a series of layers, one of which includes a layer of pixilated light transmission elements for selectively filtering red, green and blue data from a white light source. Each display device is adapted to receive signals from a processor, video processor or controller included in the gaming machine and to generate and display graphics and images to a person near the gaming machine. The format of the signal will depend on the device. In one embodiment, all the display devices in a layered arrangement respond to digital signals. For example, the red, green and blue pixilated light transmission elements for an LCD device typically respond to digital control signals to generate colored light, as desired.

In another embodiment, the gaming machine includes multiple display devices arranged in a common line of sight relative to a person near the gaming machine. Multiple display devices disposed along a common line of sight are referred to herein as 'layered' displays. In one embodiment, the gaming machine includes two display devices, including a first, foremost or exterior display device and a second, underlying or interior display device. For example, the exterior display device may include a transparent LCD panel while the interior display device includes a second LCD panel.

Layered display devices may be described according to their position along a common line of sight relative to a viewer. As the terms are used herein, 'proximate' refers to a display device that is closer to a person, along a common line of sight (such as 20 in FIG. 5A), than another display device. Conversely, 'distal' refers to a display device that is farther from a person, along the common line of sight, than another. While the layered displays of FIGS. 5A and 5B are shown set back from touchscreen 16; this is for illustrative purposes and the exterior display device 18*a* may be closer to touchscreen 16.

The video displays, however, permit digital output and all its benefits. For example, the digital domain permits external loading and changing of simulated reel games. This permits a casino or gaming establishment to change video on each of the layered display devices, and their transparency, without physically altering the gaming machine or requiring maintenance. Thus, the number of virtual video reels 104 may be changed from 3 to 5 to 9, or some other number. In this case, the intermediate and exterior display devices change the position of their transparent window portions 15 for viewing of the different number of virtual slot reels. The object designs and/or symbols on each virtual video reel 104 may also be changed. Also, a pay table shown on display device 18*a* may be changed at will, in addition to changing whether a bonus or progressive game is shown on the intermediate display device. This permits the same gaming machine to play new games simply by downloading a data onto the machine.

Referring to FIGS. 5A, 5B and 7, layered displays and their operation will be further described. Although illustrated with reference to FIGS. 5A and 5B, the operation may also apply generally to the display device of FIGS. 3A-3C. Processor 332 controls the operation of components in gaming machine 10 to present one or more games, receive player inputs using the touchscreen 16, and control other gaming interactions between the gaming machine and a person 21. Under the control of processor 332 that stores video data, display devices 18 generates the 3-D images and visual information for game play by a person 21. As shown in FIG. 4A, there are two layered display devices 18: a first, exterior or frontmost display device 18*a*, and a backmost display screen 18*c*. As shown in FIG. 4B, there are three layered display devices 18: frontmost display device 18*a*, a second or intermediate display device 18*b*, and a backmost display screen 18*c*. The display devices 18*a*, 18*b* and 18*c* are mounted and oriented within the cabinet 12 in such a manner that a straight and common line of sight 20 intersects the display screens of all three display devices 18*a*, 18*b* and 18*c*. In addition, display devices 18*a*, 18*b* and 18*c* are all relatively flat and aligned about in parallel to provide a plurality of common lines of sight that intersect screens for all three.

The proximate display devices 18*a* and 18*b* each have the capacity to be partially or completely transparent or translucent. In a specific embodiment, the relatively flat and thin display devices 18*a* and 18*b* are LCDs. Other display technologies are also suitable for use. Various companies have developed relatively flat display devices that have the capacity to be transparent or translucent. One such company is Uni-Pixel Displays, Inc., Inc. of Houston Tex., which sells display screens that employ time multiplex optical shutter (TMOS) technology. This TMOS display technology includes: (a) selectively controlled pixels that shutter light out of a light guidance substrate by violating the light guidance conditions of the substrate and (b) a system for repeatedly causing such violation in a time multiplex fashion. The display screens that embody TMOS technology are inherently transparent and they can be switched to display colors in any pixel area. A transparent OLED may also be used. An electroluminescent display is also suitable for use with proximate display devices 18*a* and 18*b*. Also, Planar Systems Inc. of Beaverton Oreg. and Samsung of Korea, both produce several display devices that are suitable for use herein and that can be translucent or transparent. Kent Displays Inc. of Kent Ohio also produces Cholesteric LCD display devices that operate as a light valve and/or a monochrome LCD panel. Other layered video display devices are discussed in detail in co-pending application Ser. No. 11/514,808, entitled "Gaming Machine With Layered Displays", filed Sep. 1, 2006, which is incorporated herein by reference in its entirety for all purposes.

In one embodiment, the gaming machine includes a touchscreen 16 disposed outside the exterior display device 18*a*. Touchscreen 16 detects and senses pressure, and in some cases varying degrees of pressure, applied by a person to the touchscreen 16. Touchscreen 16 may include a capacitive, resistive, acoustic or other pressure sensitive technology. Electrical communication between touchscreen 16 and the gaming machine processor enable the processor to detect a player pressing on an area of the display screen (and, for some touchscreens, how hard a player is pushing on a particular area of the display screen). Using one or more programs stored within memory of the gaming machine, the processor enables a player to activate game elements or functions by applying pressure to certain portions of touchscreen 16. Several vendors known to those of skill in the art produce a touchscreen suitable for use with a gaming machine.

Rear display device 18*d* may include a digital display device with a curved surface. A digital display device refers to a display device that is configured to receive and respond to a digital communication, e.g., from a processor or video card. Thus, OLED, LCD and projection type (LCD or DMD) devices are all examples of suitable digital display devices. E Ink Corporation of Cambridge MA produces electronic ink displays that are suitable for use in rear display device 18*d*. Microscale container display devices, such as those produced SiPix of Fremont Calif., are also suitable for use in rear display device 18*d*.

When portions (or all) of the screens for touchscreen 16, display devices 18*a* and 18*b*, and light valve 18*e* are transparent or translucent, a player can simultaneously see images displayed on the display screen 18*a* (and/or 18*b*)—as well as the images displayed on the interior display devices 18*c*—by looking through the transparent portions 15 of proximate display devices.

The layered display devices 18 may be used in a variety of manners to output games on a gaming machine. In some cases, video data and images displayed on the display devices 18*a* and 18*c* are positioned such that the images do not overlap (that is, the images are not superimposed). In other instances, the images overlap. It should also be appreciated that the images displayed on the display screen can fade-in fade out, pulsate, move between screens, and perform other inter-screen graphics to create additional affects, if desired.

In another specific embodiment, layered display devices 18 provide 3-D effects. A gaming machine may use a combination of virtual 3-D graphics on any one of the display devices—in addition to 3-D graphics obtained using the different depths of the layered display devices. Virtual 3-D graphics on a single screen typically involve shading, highlighting and perspective techniques that selectively position graphics in an image to create the perception of depth. These virtual 3-D image techniques cause the human eye to perceive depth in an image even though there is no real depth (the images are physically displayed on a single display screen, which is relatively thin). Also, the predetermined distance, D (between display screens for the layered display devices) facilitates the creation of 3-D effects having a real depth between the layered display devices. 3-D presentation of graphic components may then use a combination of: a) virtual 3-D graphics techniques on one or more of the multiple screens; b) the depths between the layered display devices; and c) combinations thereof. The multiple display devices may each display their own graphics and images, or cooperate to provide coordinated visual output. Objects and graphics in a game may then appear on any one or multiple of the display devices, where reels and other graphics on the proximate screen(s) block the view objects on the distal screen(s), depending on the position of the viewer relative to the screens. This provides actual perspective between the graphics objects, which represents a real-life component of 3-D visualization (and not just perspective virtually created on a single screen).

In another specific embodiment, the multiple display devices output video for different games or purposes. For example, the interior display device may output a reel game, while the intermediate display device outputs a bonus game or pay table associated with the interior display, while the exterior and foremost display device provides a progressive game or is reserved for player interaction and video output with the touchscreen. Other combinations may be used.

Figure 6A:
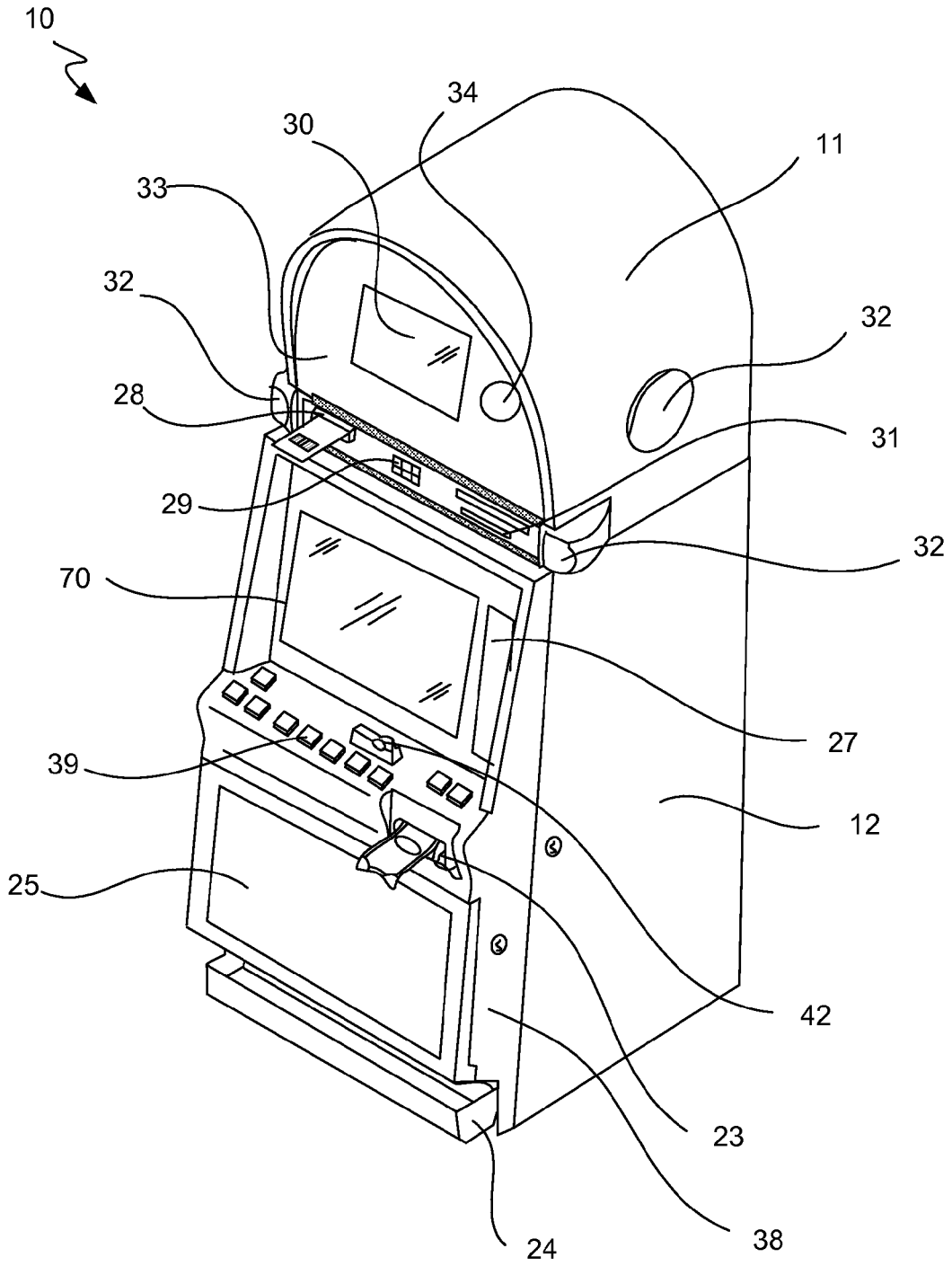
FIGS. 6A and 6B illustrate a sample gaming machine.
Figure 6B:
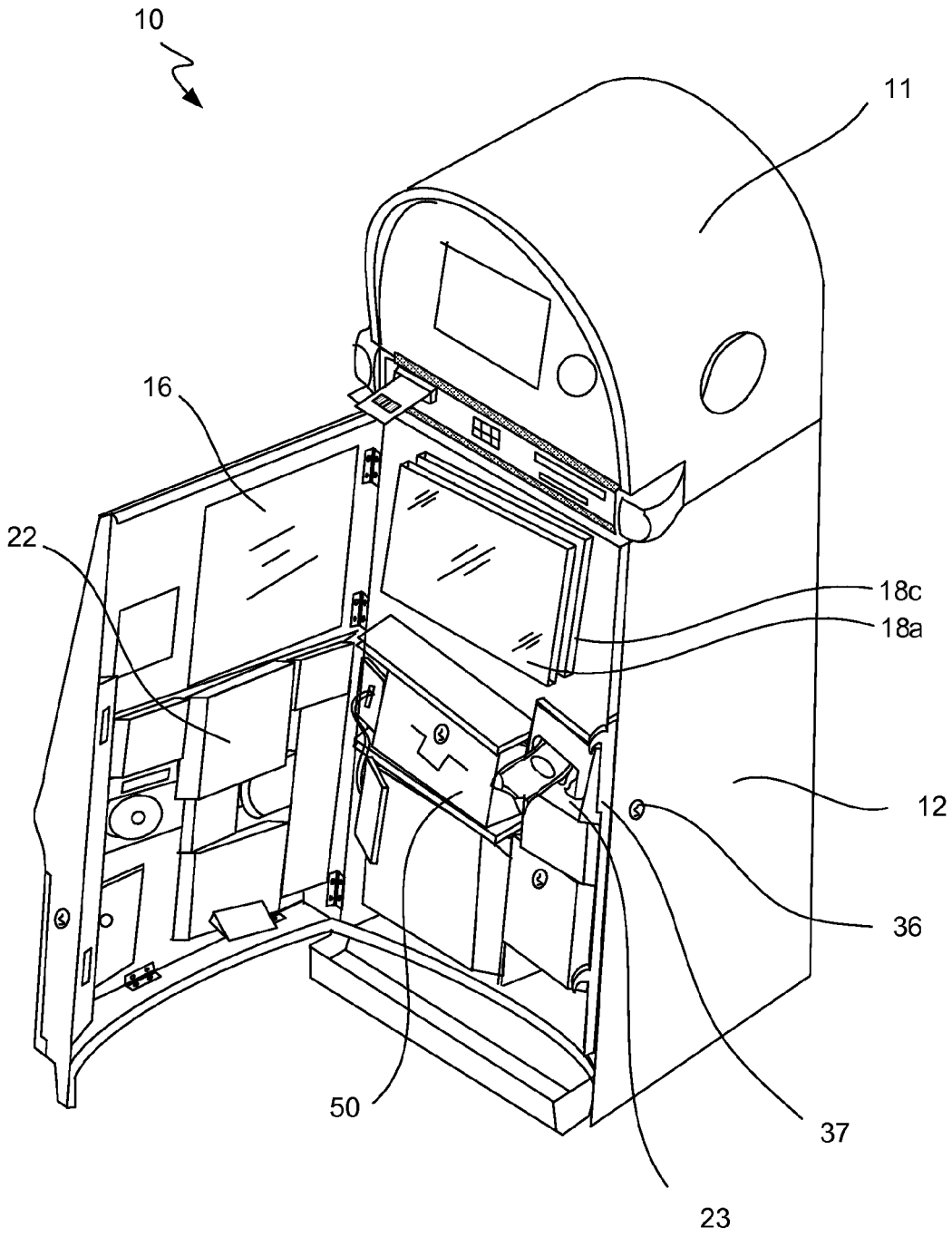

Embodiments described herein may be implemented on a wide variety of gaming machines. FIGS. 6A and 6B illustrate a sample gaming machine 10. Gaming machine 10 includes a top box 11 and a main cabinet 12, which generally surrounds the machine interior and is viewable by users. Main cabinet 12 includes a main door 38 on the front of the machine, which opens to provide access to the interior of the machine. Attached to the main door are typically one or more player-input switches or buttons 39; one or more money or credit acceptors, such as a coin acceptor 42, and a bill or ticket scanner 23; a coin tray 24; and a belly glass 25. Viewable through main door 38 is the exterior video display monitor 18*a* and one or more information panels 27.

Top box 11, which typically rests atop of the main cabinet 12, may also contain a ticket printer 28, a keypad 29, one or more additional displays 30, a card reader 31, one or more speakers 32, a top glass 33 and a camera 34. Other components and combinations are also possible, as is the ability of the top box to contain one or more items traditionally reserved for main cabinet locations, and vice versa.

It will be readily understood that gaming machine 10 can be adapted for presenting and playing any of a number of games and gaming events, particularly games of chance involving a player wager and potential monetary payout, such as, for example, a digital slot machine game and/or any other video reel game, among others. While gaming machine 10 is usually adapted for live game play with a physically present player, it is also contemplated that such a gaming machine may also be adapted for remote game play with a player at a remote gaming terminal. Such an adaptation preferably involves communication from the gaming machine to at least one outside location, such as a remote gaming terminal itself, as well as the incorporation of a gaming network that is capable of supporting a system of remote gaming with multiple gaming machines and/or multiple remote gaming terminals.

Gaming machine 10 may also be a "dummy" machine, kiosk or gaming terminal, in that all processing may be done at a remote server, with only the external housing, displays, and pertinent inputs and outputs being available to a player. Further, it is also worth noting that the term "gaming machine" may also refer to a wide variety of gaming machines in addition to traditional free standing gaming machines. Such other gaming machines can include kiosks, set-top boxes for use with televisions in hotel rooms and elsewhere, and many server based systems that permit players to log in and play remotely, such as at a personal computer or PDA. All such gaming machines can be considered "gaming machines" for embodiments described herein and following discussion, with all of the disclosed metering techniques and devices being adaptable for such uses of alternative gaming machines and devices.

With reference to FIG. 6B, the gaming machine of FIG. 6A is illustrated in perspective view with its main door opened. In additional to the various exterior items described above, such as top box 11, main cabinet 12 and primary video displays 18, gaming machine 10 also comprises a variety of internal components. As will be readily understood by those skilled in the art, gaming machine 10 contains a variety of locks and mechanisms, such as main door lock 36 and latch 37. Internal portions of coin acceptor 22 and bill or ticket scanner 23 can also be seen, along with the physical meters associated with these peripheral devices. Processing system 50 includes computer architecture, as will be discussed in further detail below.

When a person wishes to play a gaming machine 10, he or she provides coins, cash or a credit device to a scanner included in the gaming machine. The scanner may comprise a bill scanner or a similar device configured to read printed information on a credit device such as a paper ticket or magnetic scanner that reads information from a plastic card. The credit device may be stored in the interior of the gaming machine. During interaction with the gaming machine, the person views game information using a video display. Usually, during the course of a game, a player is required to make a number of decisions that affect the outcome of the game. The player makes these choices using a set of player-input switches.

After the player has completed interaction with the gaming machine, the player may receive a portable credit device from the machine that includes any credit resulting from interaction with the gaming machine. By way of example, the portable credit device may be a ticket having a dollar value produced by a printer within the gaming machine. A record of the credit value of the device may be stored in a memory device provided on a gaming machine network (e.g., a memory device associated with validation terminal and/or processing system in the network). Any credit on some devices may be used for further games on other gaming machines 10. Alternatively, the player may redeem the device at a designated change booth or pay machine.

Gaming machine 10 can be used to play any primary game, bonus game, progressive or other type of game. Other wagering games can enable a player to cause different events to occur based upon how hard the player pushes on a touch screen. For example, a player could cause reels or objects to move faster by pressing harder on the exterior touch screen. In these types of games, the gaming machine can enable the player to interact in the 3-D by varying the amount of pressure the player applies to a touchscreen.

As indicated above, gaming machine 10 also enables a person to view information and graphics generated on one display screen while playing a game that is generated on another display screen. Such information and graphics can include game paytables, game-related information, entertaining graphics, background, history or game theme-related information or information not related to the game, such as advertisements. The gaming machine can display this information and graphics adjacent to a game, underneath or behind a game or on top of a game. For example, a gaming machine could display paylines on the frontmost display screen and also display a reel game on an underlying display screen, and the paylines could fade in and fade out periodically.

A gaming machine includes one or more master gaming controllers and/or processors and memory that cooperate to output games and gaming interaction functions from stored memory. FIG. 7 illustrates a control configuration for use in a gaming machine. Processor 332 is a microprocessor or microcontroller-based platform that is capable of causing a display system 18 to output video data such as symbols, cards, images of people, characters, places, and objects which function in the gaming device. Processor 332 may include a commercially available microprocessor provided by a variety of vendors known to those of skill in the art. Gaming machine 10 may also include one or more application-specific integrated circuits (ASICs) or other hardwired devices. Furthermore, although the processor 332 and memory device 334 reside on each gaming machine, it is possible to provide some or all of their functions at a central location such as a network server for communication to a playing station such as over a local area network (LAN), wide area network (WAN), Internet connection, microwave link, and the like.

Memory 334 may include one or more memory modules, flash memory or another type of conventional memory that stores executable programs that are used by the processing system to control components in a layered display system. Memory 334 can include any suitable software and/or hardware structure for storing data, including a tape, CD-ROM, floppy disk, hard disk or any other optical or magnetic storage media. Memory 334 may also include a) random access memory (RAM) 340 for storing event data or other data generated or used during a particular game and b) read only memory (ROM) 342 for storing program code that controls functions on the gaming machine such as playing a game.

A player uses one or more input devices 338, such as a pull arm, play button, bet button or cash out button to input signals into the gaming machine. One or more of these functions could also be employed on a touch screen. In such embodiments, the gaming machine includes a touch screen controller 16*a* that communicates with a video controller 346 and processor 332. A player can input signals into the gaming machine by touching the appropriate locations on the touchscreen.

Processor 332 is also connected to a currency acceptor 326 such as the coin slot or bill acceptor. Processor 332 can operate instructions that require a player to deposit a certain amount of money in order to start the game.

Although the processing system shown in FIG. 7 is one specific processing system, it is by no means the only processing system architecture on which embodiments described herein can be implemented. Regardless of the processing system configuration, it may employ one or more memories or memory modules configured to store program instructions for gaming machine network operations and operations associated with layered display systems described herein. Such memory or memories may also be configured to store player interactions, player interaction information, and other instructions related to steps described herein, instructions for one or more games played on the gaming machine, etc.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media such as optical disks; and hardware devices that are specially configured to store and perform program instructions, such as ROM and RAM. The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

The processing system may offer any type of primary game, bonus round game or other game. In one embodiment, a gaming machine permits a player to play two or more games on two or more display screens at the same time or at different times. For example, a player can play two related games on two of the display screens simultaneously. In another example, once a player deposits currency to initiate the gaming device, the gaming machine allows a person to choose from one or more games to play on different display screens. In yet another example, the gaming device can include a multi-level bonus scheme that allows a player to advance to different bonus rounds that are displayed and played on different display screens.

Figure 8:
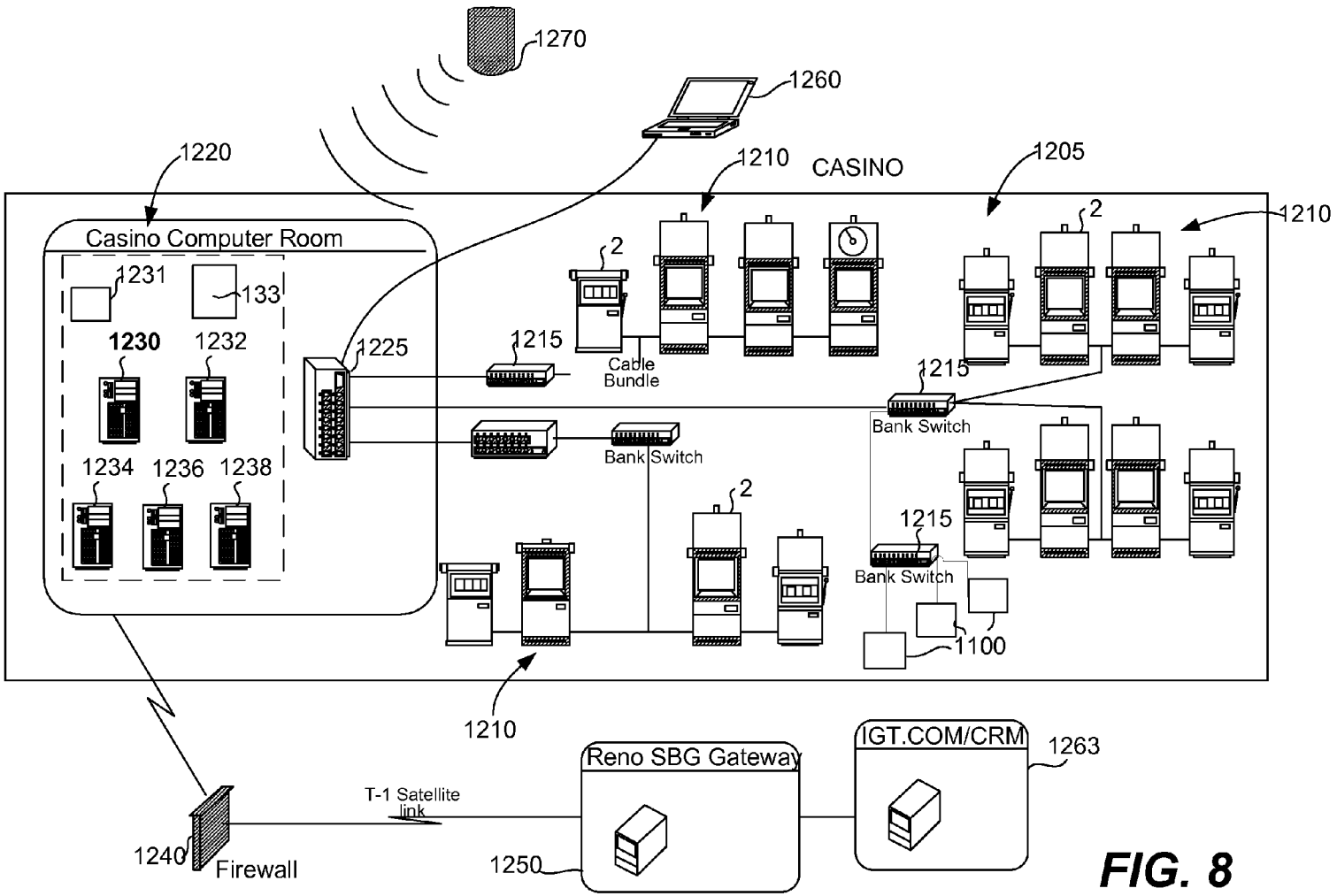
FIG. 8 illustrates an exemplary network topology.

FIG. 8 illustrates an exemplary network topology. Those of skill in the art will realize that this exemplary architecture and the related functionality are merely examples and that the present invention encompasses many other such embodiments and methods. Here, for example, a single gaming establishment 1205 is illustrated, which is a casino in this example. However, it should be understood that some implementations of the present invention involve multiple gaming establishments.

Gaming establishment 1205 includes 16 gaming machines 2, each of which is part of a bank 1210 of gaming machines 2. In this example, gaming establishment 1205 also includes a bank of networked gaming tables 1100. It will be appreciated that many gaming establishments include hundreds or even thousands of gaming machines 2 and/or gaming tables 1100, not all of which are included in a bank. However, the present invention may be implemented in gaming establishments having any number of gaming machines, gaming tables, etc.

Various alternative network topologies can be used to implement different aspects of the invention and/or to accommodate varying numbers of networked devices. For example, gaming establishments with very large numbers of gaming machines 2 may require multiple instances of some network devices (e.g., of main network device 1225, which combines switching and routing functionality in this example) and/or the inclusion of other network devices not shown in FIG. 8. For example, some implementations of the invention include one or more middleware servers disposed between gaming machines 2 and server 1230. Such middleware servers can provide various useful functions, including but not limited to the filtering and/or aggregation of data received from bank switches 1215, from individual gaming machines and from other player terminals. Some implementations of the invention include load balancing methods and devices for managing network traffic.

Each bank 1210 has a corresponding bank switch 1215, which may be a conventional bank switch. Each bank switch is connected to server-based gaming ("SBG") server 1230 via main network device 1225, which combines switching and routing functionality in this example. Although various floor communication protocols may be used, some preferred implementations use IGT's open, Ethernet-based Super-SAS® protocol, which IGT makes available for downloading without charge. However, other protocols such as Best of Breed ("BOB") may be used to implement various aspects of SBG. IGT has also developed a gaming-industry-specific transport layer called CASH that rides on top of TCP/IP and offers additional functionality and security.

SBG server 1230, License Manager 1231, Arbiter 133, servers 1232, 1234, 1236 and 1238, and main network device 1225 are disposed within computer room 1220 of gaming establishment 1205. In practice, more or fewer servers may be used. Some of these servers may be configured to perform tasks relating to player tracking, bonusing/progressives, etc. Some servers may be configured to perform tasks specific to the present invention. License Manager 1231 may also be implemented, at least in part, via a server or a similar device. Some exemplary operations of License Manager 1231 are described in detail in U.S. patent application Ser. No. 11/225,408, entitled "Methods And Devices For Authentication And Licensing In A Gaming Network" by Kinsley et al., which is hereby incorporated by reference.

SBG server 1230 can also be configured to implement, at least in part, various aspects of the present invention. Some preferred embodiments of SBG server 1230 and the other servers shown in FIG. 8 include (or are at least in communication with) clustered CPUs, redundant storage devices, including backup storage devices, switches, etc. Such storage devices may include a redundant array of inexpensive disks ("RAID"), back-up hard drives and/or tape drives, etc. Preferably, a Radius and a DHCP server are also configured for communication with the gaming network. Some implementations of the invention provide one or more of these servers in the form of blade servers.

In some implementations of the invention, many of these devices (including but not limited to License Manager 1231, servers 1232, 1234, 1236 and 1238, and main network device 1225) are mounted in a single rack with SBG server 1230. Accordingly, many or all such devices will sometimes be referenced in the aggregate as an "SBG server." However, in alternative implementations, one or more of these devices is in communication with SBG server 1230 and/or other devices of the network but located elsewhere. For example, some of the devices could be mounted in separate racks within computer room 1220 or located elsewhere on the network. For example, it can be advantageous to store large volumes of data elsewhere via a storage area network ("SAN").

In some embodiments, these components are SBG server 1230 preferably has an uninterruptible power supply ("UPS"). The UPS may be, for example, a rack-mounted UPS module.

Computer room 1220 may include one or more operator consoles or other host devices that are configured for communication with SBG server 1230. Such host devices may be provided with software, hardware and/or firmware for implementing various aspects of the invention; many of these aspects involve controlling SBG server 1230. However, such host devices need not be located within computer room 1220. Wired host device 1260 (which is a laptop computer in this example) and wireless host device (which is a PDA in this example) may be located elsewhere in gaming establishment 1205 or at a remote location.

Arbiter 133 may be implemented, for example, via software that is running on a server or another networked device. Arbiter 133 serves as an intermediary between different devices on the network. Some implementations of Arbiter 133 are described in United States patent application Ser. No. 10/948,387, entitled "Methods And Apparatus For Negotiating Communications Within A Gaming Network" and filed Sep. 23, 2004 (the "Arbiter Application"), which is incorporated herein by reference and for all purposes. In some preferred implementations, Arbiter 133 is a repository for the configuration information required for communication between devices on the gaming network (and, in some implementations, devices outside the gaming network). Although Arbiter 133 can be implemented in various ways, one exemplary implementation is discussed in the following paragraphs.

Figure 9:
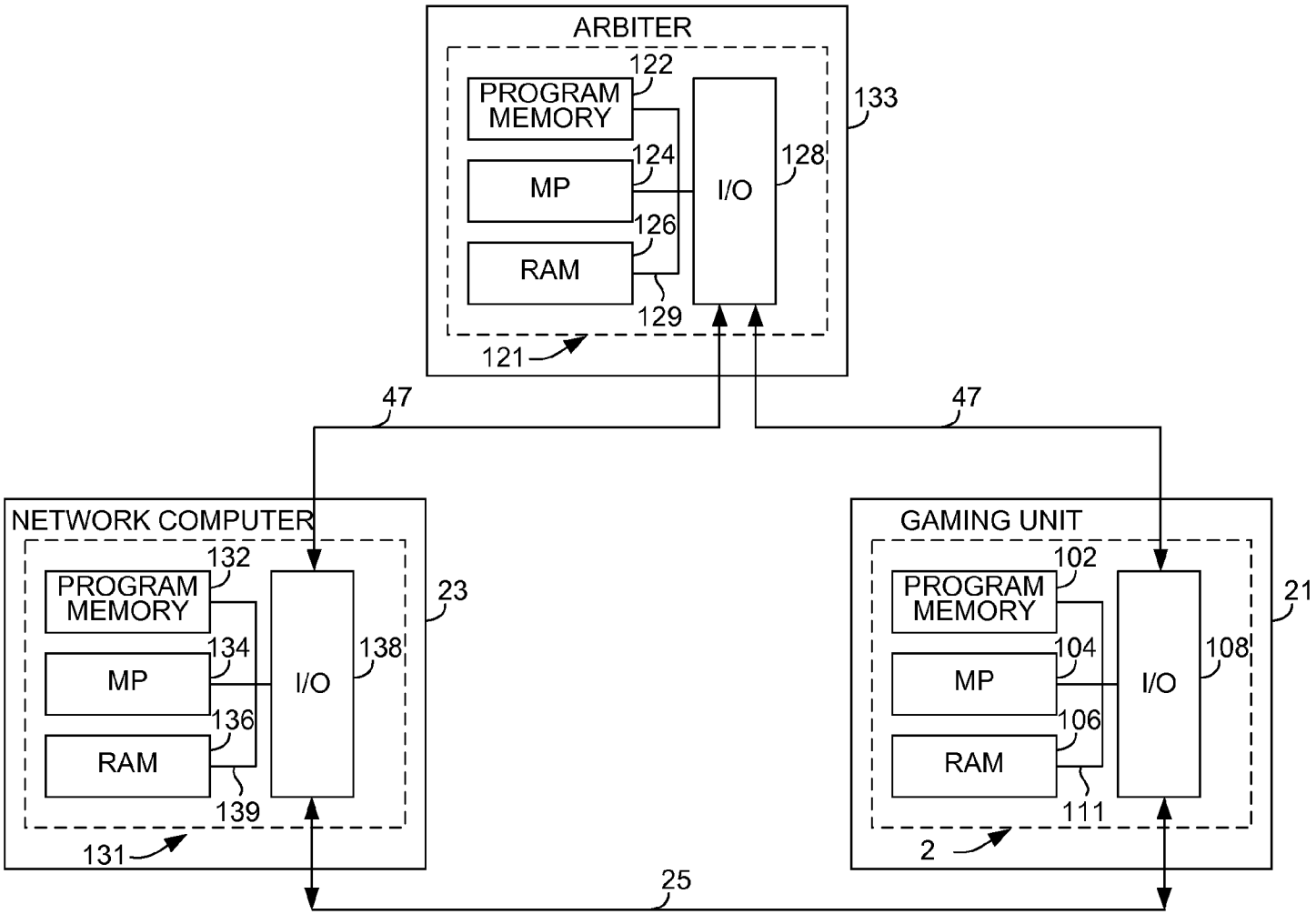
FIG. 9 is a block diagram of a simplified communication topology

FIG. 9 is a block diagram of a simplified communication topology between a gaming unit 21, the network computer 23 and the Arbiter 133. Although only one gaming unit 21, one network computer 23 and one Arbiter 133 are shown in FIG. 9, it should be understood that the following examples may be applicable to different types of network gaming devices within the gaming network 12 beyond the gaming unit 21 and the network computer 23, and may include different numbers of network computers, gaming security arbiters and gaming units. For example, a single Arbiter 133 may be used for secure communications among a plurality of network computers 23 and tens, hundreds or thousands of gaming units 21. Likewise, multiple gaming security arbiters 46 may be utilized for improved performance and other scalability factors.

Referring to FIG. 9, the Arbiter 133 may include an arbiter controller 121 that may comprise a program memory 122, a microcontroller or microprocessor (MP) 124, a random-access memory (RAM) 126 and an input/output (I/O) circuit 128, all of which may be interconnected via an address/data bus 129. The network computer 23 may also include a controller 131 that may comprise a program memory 132, a microcontroller or microprocessor (MP) 134, a random-access memory (RAM) 136 and an input/output (I/O) circuit 138, all of which may be interconnected via an address/data bus 139. It should be appreciated that although the Arbiter 133 and the network computer 23 are each shown with only one microprocessor 124, 134, the controllers 121, 131 may each include multiple microprocessors 124, 134. Similarly, the memory of the controllers 121, 131 may include multiple RAMs 126, 136 and multiple program memories 122, 132. Although the I/O circuits 128, 138 are each shown as a single block, it should be appreciated that the I/O circuits 128, 138 may include a number of different types of I/O circuits. The RAMs 124, 134 and program memories 122, 132 may be implemented as semiconductor memories, magnetically readable memories, and/or optically readable memories, for example.

Although the program memories 122, 132 are shown in FIG. 9 as read-only memories (ROM) 122, 132, the program memories of the controllers 121, 131 may be a read/write or alterable memory, such as a hard disk. In the event a hard disk is used as a program memory, the address/data buses 129, 139 shown schematically in FIG. 9 may each comprise multiple address/data buses, which may be of different types, and there may be an I/O circuit disposed between the address/data buses.

As shown in FIG. 9, the gaming unit 21 may be operatively coupled to the network computer 23 via the data link 25. The gaming unit 21 may also be operatively coupled to the Arbiter 133 via the data link 47, and the network computer 23 may likewise be operatively coupled to the Arbiter 133 via the data link 47. Communications between the gaming unit 21 and the network computer 23 may involve different information types of varying levels of sensitivity resulting in varying levels of encryption techniques depending on the sensitivity of the information. For example, communications such as drink orders and statistical information may be considered less sensitive. A drink order or statistical information may remain encrypted, although with moderately secure encryption techniques, such as RC4, resulting in less processing power and less time for encryption. On the other hand, financial information (e.g., account information, winnings, etc.), game download information (e.g., game software and game licensing information) and personal information (e.g., social security number, personal preferences, etc.) may be encrypted with stronger encryption techniques such as DES or 3-DES to provide increased security.

As disclosed in further detail in the Arbiter Application, the Arbiter 133 may verify the authenticity of each network gaming device. The Arbiter 133 may receive a request for a communication session from a network device. For ease of explanation, the requesting network device may be referred to as the client, and the requested network device may be referred to as the host. The client may be any device on the network 12 and the request may be for a communication session with any other network device. The client may specify the host, or the gaming security arbiter may select the host based on the request and based on information about the client and potential hosts. The Arbiter 133 may provide encryption keys (session keys) for the communication session to the client via the secure communication channel. Either the host and/or the session key may be provided in response to the request, or may have been previously provided. The client may contact the host to initiate the communication session. The host may then contact the Arbiter 133 to determine the authenticity of the client. The Arbiter 133 may provide affirmation (or lack thereof) of the authenticity of the client to the host and provide a corresponding session key, in response to which the network devices may initiate the communication session directly with each other using the session keys to encrypt and decrypt messages.

Alternatively, upon receiving a request for a communication session, the Arbiter 133 may contact the host regarding the request and provide corresponding session keys to both the client and the host. The Arbiter 133 may then initiate either the client or the host to begin their communication session. In turn, the client and host may begin the communication session directly with each other using the session keys to encrypt and decrypt messages. An additional explanation of the communication request, communication response and key distribution is provided in the Arbiter Application.

Wireless devices are particularly useful for managing a gaming network. Such wireless devices could include, but are not limited to, laptops, PDAs or even cellular telephones. Referring once again to FIG. 8, one or more network devices in gaming establishment 1205 can be configured as wireless access points. For example, a casino manager may use a wireless handheld device to revise and/or schedule gaming machine configurations while roaming the casino floor. Similarly, a representative of a regulatory body could use a PDA to verify gaming machine configurations, generate reports, view activity logs, etc., while on the casino floor.

If a host device is located in a remote location, security methods and devices (such as firewalls, authentication and/or encryption) should be deployed in order to prevent the unauthorized access of the gaming network. Similarly, any other connection between gaming network 1205 and the outside world should only be made with trusted devices via a secure link, e.g., via a virtual private network ("VPN") tunnel. For example, the illustrated connection between SBG 1230, gateway 1250 and central system 1263 (here, IGT.com) that may be used for game downloads, etc., is advantageously made via a VPN tunnel.

An Internet-based VPN uses the open, distributed infrastructure of the Internet to transmit data between sites. A VPN may emulate a private IP network over public or shared infrastructures. A VPN that supports only IP traffic is called an IP-VPN. VPNs provide advantages to both the service provider and its customers. For its customers, a VPN can extend the IP capabilities of a corporate site to remote offices and/or users with intranet, extranet, and dial-up services. This connectivity may be achieved at a lower cost to the gaming entity with savings in capital equipment, operations, and services. Details of VPN methods that may be used with the present invention are described in the reference, "Virtual Private Networks-Technologies and Solutions," by R. Yueh and T. Strayer, Addison-Wesley, 2001, ISBN#0-201-70209-6, which is incorporated herein by reference and for all purposes.

There are many ways in which IP VPN services may be implemented, such as, for example, Virtual Leased Lines, Virtual Private Routed Networks, Virtual Private Dial Networks, Virtual Private LAN Segments, etc. Additionally VPNs may be implemented using a variety of protocols, such as, for example, IP Security (IPSec) Protocol, Layer 2 Tunneling Protocol, Multiprotocol Label Switching (MPLS) Protocol, etc. Details of these protocols, including RFC reports, may be obtained from the VPN Consortium, an industry trade group (http://www.vpnc.com, VPNC, Santa Cruz, Calif.

For security purposes, any information transmitted to or from a gaming establishment over a public network may be encrypted. In one implementation, the information may be symmetrically encrypted using a symmetric encryption key, where the symmetric encryption key is asymmetrically encrypted using a private key. The public key may be obtained from a remote public key server. The encryption algorithm may reside in processor logic stored on the gaming machine. When a remote server receives a message containing the encrypted data, the symmetric encryption key is decrypted with a private key residing on the remote server and the symmetrically encrypted information sent from the gaming machine is decrypted using the symmetric encryption key. A different symmetric encryption key is used for each transaction where the key is randomly generated. Symmetric encryption and decryption is preferably applied to most information because symmetric encryption algorithms tend to be 100-10,000 faster than asymmetric encryption algorithms.

As mentioned elsewhere herein, U.S. patent application Ser. No. 11/225,408, entitled "Methods And Devices For Authentication And Licensing In A Gaming Network" by Kinsley et al., describes novel methods and devices for authentication, game downloading and game license management. This application has been incorporated herein by reference.

Providing a secure connection between the local devices of the SBG system and IGT's central system allows for the deployment of many advantageous features. For example, a customer (e.g., an employee of a gaming establishment) can log onto an account of central system 1263 (in this example, IGT.com) to obtain the account information such as the customer's current and prior account status.

Moreover, such a secure connection may be used by the central system 1263 to collect information regarding a customer's system. Such information includes, but is not limited to, error logs for use in diagnostics and troubleshooting. Some implementations of the invention allow a central system to collect other types of information, e.g., information about the usage of certain types of gaming software, revenue information regarding certain types of games and/or gaming machines, etc. Such information includes, but is not limited to, information regarding the revenue attributable to particular games at specific times of day, days of the week, etc. Such information may be obtained, at least in part, by reference to an accounting system of the gaming network(s), as described in U.S. patent application Ser. No. 11/225,407, by Wolf et al., entitled "Methods And Devices For Managing Gaming Networks", which has been incorporated herein by reference.

Automatic updates of a customer's SBG server may also be enabled. For example, central system 1263 may notify a local SBG server regarding new products and/or product updates. For example, central system 1263 may notify a local SBG server regarding updates of new gaming software, gaming software updates, peripheral updates, the status of current gaming software licenses, etc. In some implementations of the invention, central system 1263 may notify a local SBG server (or another device associated with a gaming establishment) that an additional theme-specific data set and/or updates for a previously-downloaded global payout set are available. Alternatively, such updates could be automatically provided to the local SBG server and downloaded to networked gaming machines.

After the local SBG server receives this information, it can identify relevant products of interest. For example, the local SBG server may identify gaming software that is currently in use (or at least licensed) by the relevant gaming entity and send a notification to one or more host devices, e.g., via email. If an update or a new software product is desired, it can be downloaded from the central system. Some relevant downloading methods are described elsewhere herein and in applications that have been incorporated herein by reference, e.g., in U.S. patent application Ser. No. 11/078,966. Similarly, a customer may choose to renew a gaming software license via a secure connection with central system 1263 in response to such a notification.

Secure communication links allow notifications to be sent securely from a local SBG server to host devices outside of a gaming establishment. For example, a local SBG server can be configured to transmit automatically generated email reports, text messages, etc., based on predetermined events that will sometimes be referred to herein as "triggers." Such triggers can include, but are not limited to, the condition of a gaming machine door being open, cash box full, machine not responding, verification failure, etc.

In addition, providing secure connections between different gaming establishments can enable alternative implementations of the invention. For example, a number of gaming establishments, each with a relatively small number of gaming machines, may be owned and/or controlled by the same entity. In such situations, having secure communications between gaming establishments makes it possible for a gaming entity to use a single SBG server as an interface between central system 1263 and the gaming establishments.

While embodiments and applications of this invention have been shown and described, it would be apparent to those skilled in the art having the benefit of this disclosure that many more modifications than mentioned above are possible without departing from the inventive concepts herein.

What is claimed is:

1. A gaming machine, comprising:

a cabinet defining an interior region of the gaming machine, the cabinet adapted to house a plurality of gaming machine components within or about the interior region;

at least one display device coupled to the cabinet capable of displaying a three-dimensional (3-D) game of chance; and at least one processor to execute instructions to display the 3-D game of chance on the display device, the at least one processor configured to display video data for:

at least one 3-D object having a first reel stop and a second reel stop associated with a first and a second payout value, respectively, the at least one 3-D object movable about a central axis to define the first reel stop, wherein the first reel stop is defined by a resting position of the at least one 3-D object, the at least one 3-D object having a first individual center point located substantially at the center of the at least one 3-D object and defining the intersection of an x-axis, a y-axis, and a z-axis, the at least one 3-D object rotatable about the first individual center point and rotatable about the x, y, and z-axes to define the second reel stop, wherein the second reel stop is defined by a resting orientation of the at least one 3-D object, the at least one 3-D object including a plurality of surfaces, each surface of the plurality of surfaces having a second individual center point located substantially at the center of its respective surface and at least one surface of the plurality of surfaces having an image disposed thereon, the image having a third reel stop associated with a third payout value, the image rotatable about the second individual center point relative to the surface on which the image is disposed, wherein the third reel stop is defined by the image substantially displayed to the player; and wherein the first payout value, the second payout value and the third payout value determine a total payout associated with an outcome of the game of chance.

2. The apparatus of claim 1, wherein the at least one display device further comprises a display screen having a plurality of display pixels and a lenticular screen coupled with the display screen.

3. The apparatus of claim 2, wherein the at least one processor is configured to receive image data relating to a combination of a plurality of perspective views of a video display image, the plurality of perspective views being interlaced to form the video display image when displayed simultaneously.

4. The apparatus of claim 1, wherein the at least one display device further comprises:

a first display device configured to output a visual image in response to a control signal and including one or more controllable transparent portions; and a second display device, arranged relative to the first display device such that a common line of sight passes through a portion of the first display device to a portion of the second display device.

5. The apparatus of claim 1, wherein the image is positioned substantially within the at least one surface of the plurality of surfaces of the at least one 3-D object.

6. The apparatus of claim 1, wherein the at least one processor is configured to move the first object at least one 3-D object and the image at:

a first orientation speed; and a second orientation speed slower than the first orientation speed, wherein the second orientation speed allows the player to view an animation of the image.

7. The apparatus of claim 1, wherein the first payout value is associated with a first orientation of the at least one 3-D object and the third payout value is associated with a second orientation of the image.

8. A three-dimensional (3-D) gaming reel, comprising:

at least one 3-D object having a first reel stop and a second reel stop associated with a first payout value and a second payout value, respectively, the at least one 3-D object movable about a central axis to define the first reel stop, wherein the first reel stop is defined by a resting position of the at least one 3-D object;

the at least one 3-D object having a first individual center point located substantially at the center of the at least one 3-D object and defining the intersection of an x-axis, a y-axis, and a z-axis, the at least one 3-D object rotatable about the first individual center point and rotatable about the x, y, and z-axes to define the second reel stop, wherein the second reel stop is defined by a resting orientation of the at least one 3-D object;

the at least one 3-D object including a plurality of surfaces, each surface of the plurality of surfaces having a second individual center point located substantially at the center of its respective surface and at least one surface of the plurality of surfaces having an image disposed thereon, the image having a third reel stop associated with a third payout value, the image rotatable about the second individual center point relative to the surface on which the image is disposed, wherein the third reel stop is defined by the image substantially displayed to the player; and wherein the first payout value, the second payout value and the third payout value determine a total payout associated with an outcome of the game of chance.

9. The gaming reel of claim 8, further comprising at least one processor to execute instructions to display the 3-D gaming reel on at least one display device.

10. The gaming reel of claim 9, wherein the at least one display device further comprises a display screen having a plurality of display pixels and a lenticular screen coupled with the display screen.

11. The gaming reel of claim 9, wherein the at least one display device further comprises:

a first display device configured to output a visual image in response to a control signal and including one or more controllable transparent portions; and a second display device, arranged relative to the first display device such that a common line of sight passes through a portion of the first display device to a portion of the second display device.

12. The gaming reel of claim 8, wherein the image is positioned substantially within the at least one surface of the plurality of surfaces of the at least one 3-D object.

13. The gaming reel of claim 8, wherein the first payout value is associated with a first orientation of the at least one 3-D object and the third payout value is associated with a second orientation of the image.

14. A method for displaying a game of chance on a gaming machine, comprising:

moving at least one three-dimensional (3-D) object along a virtual reel path about a central axis to define a first reel stop associated with a first payout value;

rotating the at least one 3-D object about a first individual center point located substantially at the center of the at least one 3-D object and about an x-axis, a y-axis, and a z-axis of the at least one 3-D object to define a second reel stop, the intersection of the x, y, and z-axes defined by the first individual center point, the at least one 3-D object including a plurality of surfaces, each surface of the plurality of surfaces having a second individual center point located substantially at the center of its respective surface and at least one surface of the plurality of surfaces having an image disposed thereon;

rotating the image about the second individual center point relative to the surface on which the image is disposed to define a third reel stop;

stopping the at least one 3-D object at the first reel stop along the virtual reel path and at the second reel stop about the first individual center point, wherein the first reel stop is defined by a resting position of the at least one 3-D object and the second reel stop is defined by a resting orientation of the at least one 3-D object, the first reel stop associated with a first payout value and the second reel stop associated with a second payout value;

stopping the image at the third reel stop about the second individual center point, the third reel stop associated with a third payout value and wherein the third reel stop is defined by a resting orientation of the image that is substantially displayed to a player at the third reel stop; and determining a total payout associated with an outcome of the game of chance based upon the first payout value, the second payout value and the third payout value.

15. The method of claim 14, wherein the image is positioned substantially within the at least one surface of the plurality of surfaces of the at least one 3-D object.

16. The method of claim 14, wherein the displaying further comprises:

outputting a visual image in response to a control signal on a first display device, the visual image including one or more controllable transparent portions; and arranging a second display device relative to the first display device such that a common line of sight passes through a portion of the first display device to a portion of the second display device.

17. The method of claim 14, wherein the rotating the at least one first object and the at least one second object further comprises:

spinning the at least one 3-D object and the image at a first speed;

spinning the at least one 3-D object and the image at a second speed slower than the first speed, wherein the second speed allows a user to view an animation of the image.

18. A program storage device readable by a machine tangibly embodying a program of instructions executable by the machine to perform a method for displaying a game of chance on a gaming machine, the method comprising:

moving at least one three-dimensional (3-D) object along a virtual reel path about a central axis to define a first reel stop associated with a first payout value;

rotating the at least one 3-D object about a first individual center point located substantially at the center of the at least one 3-D object and about an x-axis, a y-axis, and a z-axis of the at least one 3-D object to define a second reel stop, the intersection of the x, y, and z-axes defined by the first individual center point, the at least one 3-D object including a plurality of surfaces, each surface of the plurality of surfaces having a second individual center point located substantially at the center of its respective surface and at least one surface of the plurality of surfaces having an image disposed thereon;

rotating the image about the second individual center point relative to the surface on which the image is disposed to define a third reel stop;

stopping the at least one 3-D object at the first reel stop along the virtual reel path and at the second reel stop about the first individual center point, wherein the first reel stop is defined by a resting position of the at least one 3-D object and the second reel stop is defined by a resting orientation of the at least one 3-D object, the first reel stop associated with a first payout value and the second reel stop associated with a second payout value;

stopping the image at the third reel stop about the second individual center point, the third reel stop associated with a third payout value and wherein the third reel stop is defined by a resting orientation of the image that is substantially displayed to a player at the third reel stop; and determining a total payout associated with an outcome of the game of chance based upon the first payout value, the second payout value and the third payout value.

19. A gaming apparatus, comprising:

means for moving at least one three-dimensional (3-D) object along a virtual reel path about a central axis to define a first reel stop associated with a first payout value;

means for rotating the at least one 3-D object about a first individual center point located substantially at the center of the at least one 3-D object and about an x-axis, a y-axis, and a z-axis of the at least one 3-D object to define a second reel stop, the intersection of the x, y, and z-axes defined by the first individual center point, the at least one 3-D object including a plurality of surfaces, each surface of the plurality of surfaces having a second individual center point located substantially at the center of its respective surface and at least one surface of the plurality of surfaces having an image disposed thereon;

means for rotating the image about the second individual center point relative to the surface on which the image is disposed to define a third reel stop;

means for stopping the at least one 3-D object at the first reel stop along the virtual reel path and at the second reel stop about the first individual center point, wherein the first reel stop is defined by a resting position of the at least one 3-D object and the second reel stop is defined by a resting orientation of the at least one 3-D object, the first reel stop associated with a first payout value and the second reel stop associated with a second payout value;

means for stopping the image at the third reel stop about the second individual center point, the third reel stop associated with a third payout value and wherein the third reel stop is defined by a resting orientation of the image that is substantially displayed to a player at the third reel stop; and means for determining a total payout associated with an outcome of the game of chance based upon the first payout value, the second payout value and the third payout value.

* * * * *